US012044480B2

(12) United States Patent
Onaka et al.

(10) Patent No.: US 12,044,480 B2
(45) Date of Patent: Jul. 23, 2024

(54) HEAT EXCHANGER AND AIR-CONDITIONING APPARATUS INCLUDING THE SAME

(71) Applicant: Mitsubishi Electric Corporation, Tokyo (JP)

(72) Inventors: Yoji Onaka, Tokyo (JP); Takashi Matsumoto, Tokyo (JP); Rihito Adachi, Tokyo (JP); Ryota Akaiwa, Tokyo (JP); Takashi Sekiya, Tokyo (JP); Hayato Taniue, Tokyo (JP); Satomi Asai, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 254 days.

(21) Appl. No.: 17/310,216

(22) PCT Filed: Feb. 4, 2019

(86) PCT No.: PCT/JP2019/003823
§ 371 (c)(1),
(2) Date: Jul. 27, 2021

(87) PCT Pub. No.: WO2020/161761
PCT Pub. Date: Aug. 13, 2020

(65) Prior Publication Data

US 2022/0316804 A1 Oct. 6, 2022

(51) Int. Cl.
*F28D 1/053* (2006.01)
*F25B 39/02* (2006.01)
(Continued)

(52) U.S. Cl.
CPC ..... *F28D 1/05391* (2013.01); *F25B 39/028* (2013.01); *F25B 40/02* (2013.01);
(Continued)

(58) Field of Classification Search
CPC ..... F28D 1/05391; F28D 2021/0068; F25B 39/028; F25B 40/02; F28F 9/0214; F28F 9/0224; F28F 9/0273; F28F 9/0278
See application file for complete search history.

(56) References Cited

U.S. PATENT DOCUMENTS 2,044,455 A * 6/1936 Witzel ..... F25B 39/028 165/174
2,099,186 A * 11/1937 Anderegg ..... F25B 39/028 165/110
(Continued)

FOREIGN PATENT DOCUMENTS

CN 104422200 A 3/2015
DE 11 2014 003 913 T5 5/2016
(Continued)

OTHER PUBLICATIONS

International Search Report and Written Opinion mailed on Apr. 9, 2019, received for PCT Application PCT/JP2019/003823, Filed on Feb. 4, 2019, 19 pages including English Translation.
(Continued)

*Primary Examiner* — Raheena R Malik
(74) *Attorney, Agent, or Firm* — XSENSUS LLP

(57) ABSTRACT

A heat exchanger includes a tubular refrigerant distributor having insertion holes spaced from each other in a first direction and into which ends of heat transfer tubes are inserted in a second direction. A first partition plate partitions the refrigerant distributor into a first space into which the ends of the heat transfer tubes are inserted and a second space, larger than the first space, into which the ends of the heat transfer tubes are not inserted; and an inflow pipe provided on a one side-surface side of the refrigerant distributor. The heat transfer tubes are located apart from the first partition plate in the first space. The first partition plate is provided with an orifice that is provided at a location
(Continued)

corresponding to a space between adjacent ones of the heat transfer tubes, and that causes the first space and the second space to communicate with each other.

27 Claims, 16 Drawing Sheets

(51) Int. Cl.
*F25B 40/02* (2006.01)
*F28F 9/02* (2006.01)
*F28D 21/00* (2006.01)

(52) U.S. Cl.
CPC ..... *F28F 9/0214* (2013.01); *F28F 9/0224* (2013.01); *F28F 9/0273* (2013.01); *F28F 9/0278* (2013.01); *F28D 2021/0068* (2013.01)

(56) References Cited

U.S. PATENT DOCUMENTS 3,976,128 A * 8/1976 Patel ..... F25B 39/02 165/174
5,901,785 A * 5/1999 Chiba ..... F28F 9/027 165/DIG. 465
5,988,267 A * 11/1999 Park ..... F28D 1/05375 165/110
6,082,448 A * 7/2000 Haussmann ..... F28D 1/05391 165/158
6,199,401 B1 * 3/2001 Haussmann ..... F28D 1/05391 165/DIG. 466
6,827,139 B2 * 12/2004 Kawakubo ..... F28F 9/0243 165/173
7,066,243 B2 * 6/2006 Horiuchi ..... F28F 9/0278 165/174
7,398,819 B2 * 7/2008 Taras ..... F28D 1/05383 165/906
7,562,697 B2 * 7/2009 Gorbounov ..... F28F 9/0278 165/174
7,726,389 B2 * 6/2010 Watanabe ..... F25B 39/022 62/515
7,895,860 B2 * 3/2011 Tucker ..... F28F 1/025 62/515
8,176,750 B2 * 5/2012 Higashiyama ..... F25B 39/028 62/515
8,250,874 B2 * 8/2012 Ikegami ..... F25B 13/00 62/509
9,027,676 B2 * 5/2015 Nakashima ..... F01N 3/05 180/9.1
9,200,822 B2 * 12/2015 Jeon ..... F28F 9/0246
9,976,784 B2 * 5/2018 Hirayama ..... F28D 1/05341
10,072,900 B2 * 9/2018 Pettitt ..... F28F 9/0273
10,161,685 B2 * 12/2018 Voorhis, Jr ..... F28D 1/05391
10,345,047 B2 * 7/2019 Jindou ..... F25B 39/022
10,408,510 B2 * 9/2019 Kamoshida ..... F28D 1/05391
10,527,366 B2 * 1/2020 Kim ..... F28D 1/05391
10,591,227 B2 * 3/2020 Lu ..... F28F 9/0207
10,718,554 B2 * 7/2020 Hirai ..... F28F 9/0273
2004/0159121 A1 * 8/2004 Horiuchi ..... F28F 21/089 62/526
2008/0023185 A1 * 1/2008 Beamer ..... F28F 9/0246 165/174
2008/0092587 A1 * 4/2008 Gorbounov ..... F25B 41/39 165/104.21
2008/0141706 A1 * 6/2008 Tucker ..... F25B 39/028 165/173
2008/0202153 A1 * 8/2008 Watanabe ..... F28F 17/005 165/153
2008/0289806 A1 * 11/2008 Gorbounov ..... F25B 39/028 165/173
2008/0296003 A1 * 12/2008 Higashiyama ..... F25B 39/028 165/153
2010/0206535 A1 * 8/2010 Munoz ..... F28F 9/0204 165/173
2011/0139413 A1 * 6/2011 Coyle ..... F28F 1/022 165/148
2011/0240276 A1 * 10/2011 Wintersteen ..... F28D 1/05383 165/173
2011/0303401 A1 * 12/2011 Kamoshida ..... F28D 1/05391 165/173
2011/0315364 A1 * 12/2011 Matter, III ..... B23P 15/26 165/177
2012/0096894 A1 * 4/2012 Higashiyama ..... F28F 9/0204 62/525
2013/0292104 A1 * 11/2013 Park ..... F28D 1/05391 165/173
2013/0312453 A1 * 11/2013 Jeon ..... F28F 9/26 62/524
2016/0201990 A1 * 7/2016 Voorhis, Jr. ..... F28D 1/05391 165/174
2016/0209091 A1 * 7/2016 Zhou ..... F28F 9/0273
2016/0209130 A1 * 7/2016 Seo ..... F28F 9/0253
2016/0356532 A1 * 12/2016 Wijaya ..... F28F 9/0204
2017/0122630 A1 * 5/2017 Okazaki ..... F25B 40/00
2017/0138675 A1 * 5/2017 Lu ..... F28D 1/05366
2017/0219298 A1 * 8/2017 Tsutsui ..... F28D 1/053
2017/0343290 A1 * 11/2017 Jindou ..... F28F 17/00
2018/0017297 A1 * 1/2018 Arino ..... F28F 9/0251
2018/0073819 A1 * 3/2018 Kim ..... F28F 9/028
2018/0135901 A1 * 5/2018 Hirai ..... F28D 1/05391
2018/0180335 A1 * 6/2018 Kamoshida ..... B60H 1/3227
2022/0316804 A1 * 10/2022 Onaka ..... F25B 39/028

FOREIGN PATENT DOCUMENTS

EP 3425320 A1 1/2019
JP 2017-32244 A 2/2017
JP 2017-44428 A 3/2017
JP 2017-519961 A 7/2017
JP 2017-155992 A 9/2017
JP 2017-211113 A 11/2017
JP 6352401 B2 7/2018
JP 2018-169062 A 11/2018
WO 2006/083451 A2 8/2006

OTHER PUBLICATIONS

Notice of Reasons for Refusal mailed on Sep. 3, 2019, received for JP Application 2019-542740, 25 pages Including English Translation.
Extended European search report issued on Jan. 19, 2022, in corresponding European patent Application No. 19914635.8, 7 pages.
Chinese Office Action issued Sep. 13, 2022 in corresponding Chinese Patent Application No. 201980088021.4 (with machine-generated English translation), 13 pages.

* cited by examiner

HEAT EXCHANGER AND AIR-CONDITIONING APPARATUS INCLUDING THE SAME

CROSS-REFERENCE TO RELATED APPLICATION

The present application is based on PCT filing PCT/JP2019/003823, filed Feb. 4, 2019, the entire contents of which are incorporated herein by reference.

TECHNICAL FIELD

The present disclosure relates to a heat exchanger that distributes two-phase gas-liquid refrigerant from a refrigerant distributor to heat transfer tubes, and an air-conditioning apparatus including the heat exchanger.

BACKGROUND ART

In an existing air-conditioning apparatus, liquid refrigerant condensed by a heat exchanger that is provided in an indoor unit and operates as a condenser is reduced in pressure by an expansion valve to change into two-phase gas-liquid liquid in which gas refrigerant and liquid refrigerant mixes with each other. Then, the two-phase gas-liquid refrigerant flows into a heat exchanger that is provided in an outdoor unit and operates as an evaporator. Furthermore, a heat exchanger is configured such that flat tubes are used as heat transfer tubes and corrugated fins are each provided between associated adjacent flat tubes. The heat exchanger having this configuration is a high-performance heat exchanger. However, in the existing air-conditioning apparatus, it has been required as a task to develop refrigerant distributor capable of evenly distributing refrigerant to a plurality of flat tubes.

In order to improve the refrigerant distribution performance, there has been proposed a method intended to improve refrigerant distribution by applying a header having a double-tube structure to a refrigerant distributor (see, for example, Patent Literature 1). In Patent Literature 1, a header of a heat exchanger is made to have a double-tube structure, orifices are provided in inner tubes of double tubes, and the positons of the orifices are adjusted, thereby uniformizing distribution of refrigerant to a plurality of flat tubes and improving a refrigerant distribution performance of a refrigerant distributor.

CITATION LIST

Patent Literature

Patent Literature 1: Japanese Unexamined Patent Application Publication No. 2017-32244

SUMMARY OF INVENTION

Technical Problem

However, in such an existing heat exchanger as described in Patent Literature 1, it is necessary to ensure sufficient edges for brazing in order to join flat tubes to a double tube by brazing. Thus, the flat tubes are larger in a width direction than in the case where heat transfer tubes are circular pipes, and the diameter of an outer pipe of the double pipe is larger. Inevitably, a larger amount of refrigerant collects in a header. Furthermore, in order to reduce the amount of refrigerant, in the case of decreasing the diameters of the outer pipe and inner pipe of the double pipe, a fluid resistance is increased, and refrigerant distribution performance is thus deteriorated.

The present disclosure is applied to solve the above problem, and relates to a heat exchanger that can improve a refrigerant distribution performance while reducing the volume of a refrigerant distributor and an air-conditioning apparatus including the heat exchanger.

Solution to Problem

A heat exchanger according to an embodiment of the present disclosure includes: a plurality of heat transfer tubes; and a tubular refrigerant distributor having insertion holes that are spaced from each other in a first direction, and that are provided as holes into which ends of the heat transfer tubes are inserted in a second direction. The refrigerant distributor includes: a first partition plate that partitions the interior of the refrigerant distributor into a first space into which the ends of the heat transfer tubes are inserted and a second space into which the ends of the heat transfer tubes are not inserted, the second space being larger in volume than the first space; and an inflow pipe provided on a one side-surface side of the refrigerant distributor, and provided to allow two-phase gas-liquid refrigerant to flow into the second space. The heat transfer tubes are inserted in the insertion holes such that the ends of the heat transfer tubes are located apart from the first partition plate in the first space. The first partition plate is provided with an orifice that is provided at a location corresponding to a space between adjacent ones of the heat transfer tubes, and that causes the first space and the second space to communicate with each other.

Further, an air-conditioning apparatus according to another embodiment of the present disclosure includes a refrigerant circuit in which a compressor, a condenser, an expansion valve, and an evaporator are connected by pipes and through which refrigerant flows, the above heat exchanger being used as the condenser or the evaporator.

Advantageous Effects of Invention

In the heat exchanger and the air-conditioning apparatus according to the embodiment of the present disclosure, the interior of the refrigerant distributor is partitioned by the first partition plate into a first space into which the ends of the heat transfer tubes are inserted and a second space into which the ends of the heat transfer tubes are not inserted and that is larger in volume than the first space. Further, the heat transfer tubes are inserted in the insertion holes such that the ends of the heat transfer tubes are located apart from the first partition plate in the first space, and the first partition plate is provided with an orifice that is provided at a location corresponding to an space between adjacent ones of the heat transfer tubes, and that causes the first space and the second space to communicate with each other. Because of such a configuration, it is possible to divide a refrigerant flow passage into the first space and the second space and further reduce fluid resistance at connections between the heat transfer tubes and the refrigerant distributor than in the case where the interior of the refrigerant distributor is not divided into two spaces. It is therefore possible to reduce the volume of the refrigerant distributor. Furthermore, the first space communicates with the second space in the first direction, and part of the two-phase gas ejected from the orifice into the space formed by the adjacent heat transfer tubes is mixed. Therefore, the refrigerant distribution performance can be improved, and the heat exchanger performance can also be improved.

DESCRIPTION OF EMBODIMENTS

Embodiments of the present disclosure will be described with reference to the figures. In each of the figures, components that are the same as or corresponds to those in a previous figure or figures are denoted by the same reference signs. The same is true of the entire text of the specification. Furthermore, the configurations of components described in the entire text of the specification are merely examples. That is, the configurations of the components are not limited to those described in the entire text. Furthermore, directions perpendicular to each other will be referred to as a first direction, a second direction, and a third direction in the entire text of the specification. In addition, although the following description is made by way of example on the assumption that the first direction is a horizontal direction, the second direction is a vertical direction, and a third direction is a width direction that is a direction along a width of a refrigerant distributor, the first direction, the second direction, and the third direction are not limited to flow directions of refrigerant or other directions.

Furthermore, in the following description, in order that the description be easily understood, terms indicating directions, such as "upper", "lower", "right", and "left", are used as appropriate; however, they are used just for explanation, and are not used as limitations. In addition, in the entire text of the specification, the terms such as "upper", "lower", "right", and "left" are used, with a heat exchanger 100 viewed side-on.

Embodiment 1

Figure 1:
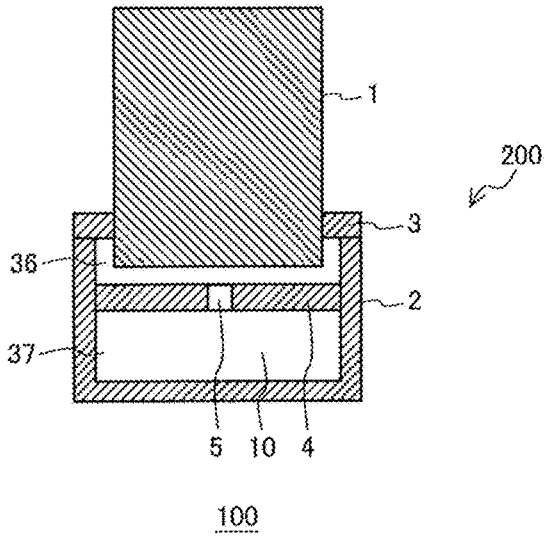
FIG. 1 is an example of a schematic side view of a vertical section of a heat exchanger according to Embodiment 1 of the present disclosure.
Figure 2:
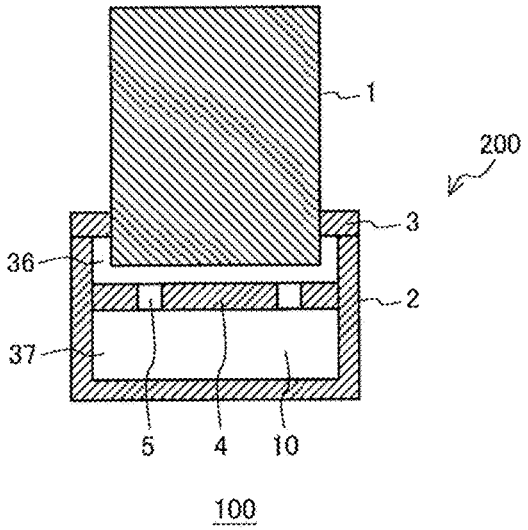
FIG. 2 is an example of a schematic side view of a vertical section of a heat exchanger according to a modification of Embodiment 1 of the present disclosure.
Figure 3:
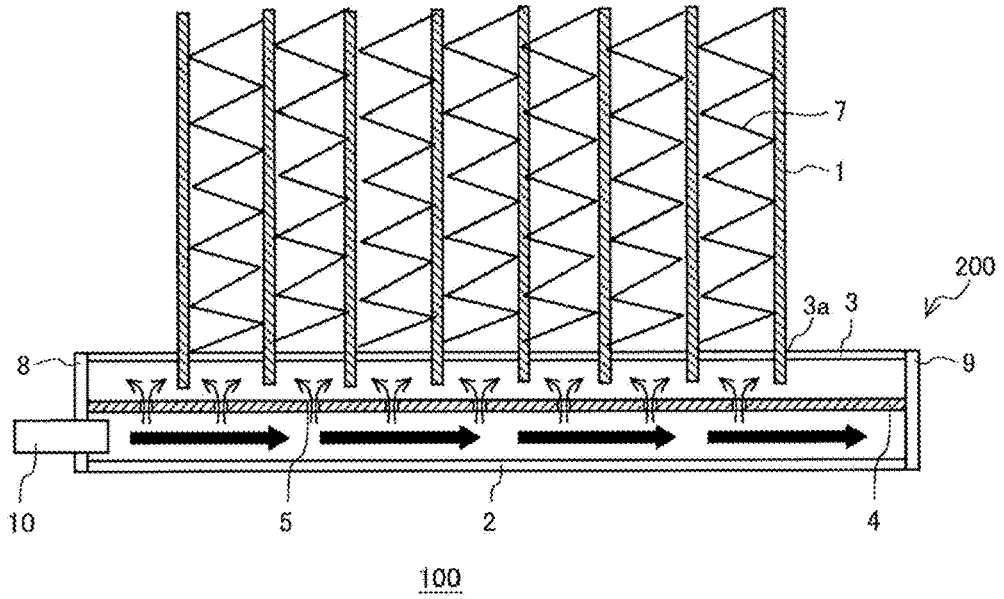
FIG. 3 is an example of a schematic front view of a vertical section of the heat exchanger according to Embodiment 1 of the present disclosure.

FIG. 1 is an example of a schematic side view of a vertical section of a heat exchanger 100 according to Embodiment 1 of the present disclosure. FIG. 2 is an example of a schematic side view of a vertical section of a heat exchanger 100 according to a modification of Embodiment 1 of the present disclosure. FIG. 3 is an example of a schematic front view of a vertical section of the heat exchanger 100 according to Embodiment 1 of the present disclosure.

As illustrated in FIGS. 1 and 3, the heat exchanger 100 according to Embodiment 1 includes a plurality of flat tubes 1, corrugated fins 7, and a refrigerant distributor 200. The refrigerant distributor 200 includes a header outer-pipe bottom plate 2, a header outer-pipe top plate 3, a first partition plate 4, an upstream side-surface lid 8, a downstream side-surface lid 9, and an inflow pipe 10.

The refrigerant distributor 200 has a tubular shape, extends in a horizontal direction (i.e. a direction perpendicular to the plane of FIG. 1), and has a rectangular section in a vertical direction (i.e. an upward/downward direction in FIG. 1). The first partition plate 4 is provided with a plurality of orifices 5 arranged along a horizontal direction. The orifices 5 may be provided offset from each other in the width direction of the refrigerant distributor 200 (i.e. a lateral direction in FIG. 1). Because of such a configuration, it is possible to reduce the effect of disturbance in which an upstream one of adjacent orifices 5 disturbs the flow of refrigerant through a downstream one of the adjacent orifices 5, and improve a refrigerant distribution performance.

Alternatively, as illustrated in FIG. 2, a plurality of orifices 5 may be provided in the width direction of the refrigerant distributor 200. Because of such a configuration, it is possible to improve a distribution performance in the width direction. This effect is especially remarkable in a heat exchanger 100 in which heat transfer tubes are flat tubes 1 that are long in the width direction of the refrigerant distributor 200 and the refrigerant distributor 200 has an internal flow passage that is larger in width than each of the flat tubes 1. However, needless to say, not the flat tubes 1 but circular tubes may be used as the heat transfer tubes. Even in the case where the heat transfer tube are circular pipes, it is possible to reduce the volume of the refrigerant distributor 200.

Ends of the flat tubes 1 are inserted in insertion holes 3*a* spaced from each other in the longitudinal direction of the header outer-pipe top plate 3 and arranged at regular intervals in the longitudinal direction of the refrigerant distributor 200. It should be noted that the insertion holes 3*a* are longer in the third direction than in the first direction. The flat tubes 1 each have a rectangular cross section in the horizontal direction that faces the header outer-pipe top plate 3. Furthermore, between adjacent flat tubes 1, corrugated fins 7 are provided, and the corrugated fins 7 are joined to surfaces of outer pipes of the flat tubes 1. Moreover, to ends of the header outer-pipe bottom plate 2, the header outer-pipe top plate 3, and the first partition plate 4, the upstream side-surface lid 8 and the downstream side-surface lid 9 are connected. In addition, the inflow pipe 10 is connected to the upstream side-surface lid 8 in such a manner as to extend through the upstream side-surface lid 8. The interior of the refrigerant distributor 200 is partitioned by the first partition plate 4 into upper and lower spaces, that is, a first space 36 and a second space 37, and the inflow pipe 10 communicates with the second space 37.

In the following, it is assumed that "upstream side" is a side of the refrigerant distributor 200 on which the upstream side-surface lid 8 is provided, and "downstream side" is a side of the refrigerant distributor 200 on which the downstream side-surface lid 9 is provided.

Next, the flow of two-phase gas-liquid refrigerant that flows in the interior of the refrigerant distributor 200 will be described with reference to FIG. 3. In FIG. 3, arrows indicate flows of the two-phase gas-liquid refrigerant.

The two-phase gas-liquid refrigerant flows into the refrigerant distributor 200 through the inflow pipe 10 and flows toward the downstream side-surface lid 9 through a refrigerant flow passage that is the second space 37, which is defined by the first partition plate 4 and the header outer-pipe bottom plate 2. Then, in the process, the refrigerant is atomized through the orifices 5 in sequence into the first space 36, which is defined by the first partition plate 4, the header outer-pipe top plate 3, and the header outer-pipe bottom plate 2. The refrigerant thus atomized is stirred in spaces provided between adjacent flat tubes 1, and in the modification, is distributed to the flat tubes 1 in a state in which gas-liquid refrigerant atomized from right and left orifices 5 is homogenized and an imbalance in distribution between the right and left orifices 5 is reduced. After that, the refrigerant flows while evaporating by exchanging heat with outside air in the process of flowing through the flat tubes 1.

In such a manner, since a refrigerant flow passage that is an internal space in the refrigerant distributor 200 is provided to have a two-layer structure, it is possible to reduce contraction fluid resistance and expansion fluid resistance that are generated in parts of the flat tubes 1 inserted in the refrigerant distributor 200. Accordingly, the refrigerant distributor 200 can be made thinner.

Figure 4:
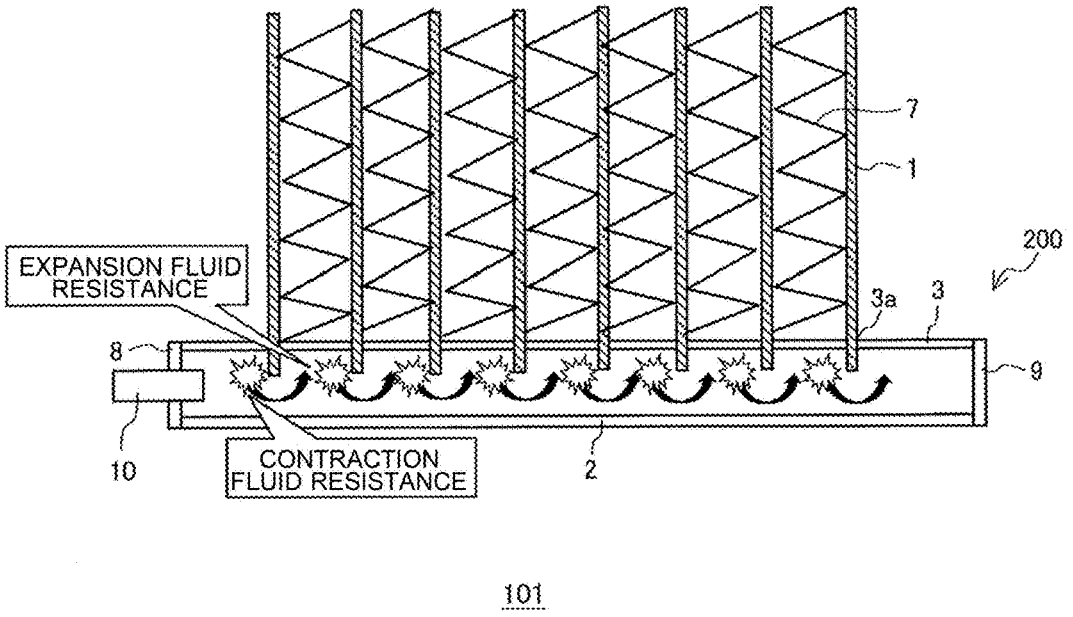
FIG. 4 is an example of a schematic front view of a vertical section of an existing heat exchanger in which a refrigerant flow passage having a single-layer structure is provided.

FIG. 4 is an example of a schematic front view of a vertical section of an existing heat exchanger 101 in which a refrigerant flow passage has a single-layer structure.

As illustrated in FIG. 4, in the case where the refrigerant flow passage has a single-layer structure, two-phase gas-liquid refrigerant collides with parts of the flat tubes 1 inserted in the interior of the refrigerant distributor 200 through the insertion holes 3*a*, and great fluid resistance is generated in the process of the refrigerant that flows through the passage thus contracted. Furthermore, when the refrigerant passes through the flat tubes 1, the flow passage expands, and accordingly, an expansion fluid resistance is generated.

The inventors found through their experiments and calculations that in the above refrigerant distributor 200, approximately 50% or more of the pressure loss is caused by the contraction and expansion of the flow passage rather than friction fluid resistance of internal fluid resistance, which is inversely proportional to the area of the flow passage. The inventors also found that the above is remarkable especially in the case where when the flat tubes 1 are connected to the header outer-pipe top plate 3, the flat tubes 1 are inserted into the refrigerant distributor 200 by ¼ or more of the height of the flow passage in the refrigerant distributor 200 in order to ensure edges for brazing.

Thus, it is more appropriate that as illustrated in FIGS. 1 and 3, the first partition plate 4 is provided in the refrigerant distributor 200 to reduce fluid resistance caused by contraction and expansion of the flow passage. This results in reduction in the thickness of the refrigerant distributor 200. Furthermore, it was found that in the above case, it is possible to reduce the section area and volume of the flow passage and improve the distribution while reducing the amount of refrigerant.

Although a section of the refrigerant distributor 200 according to Embodiment 1 in the vertical direction is rectangular, the shape of the section is not limited to the rectangular shape. For example, the refrigerant distributor 200 according to Embodiment 1 may be formed to have, for example, a circular shape or an elliptical shape. However, in order to ensure edges for brazing, it is more preferable that the refrigerant distributor 200 be formed to have a D shape or a rectangular shape such that surfaces of the refrigerant distributor 200 that are connected to the flat tubes 1 are linear in shape, since minimum edges for brazing are easily ensured.

Furthermore, of spaces in the refrigerant distributor 200 that are isolated from each other by the first partition plate 4, the first space 36 into which the ends of the flat tubes 1 are inserted extends in the longitudinal direction of the refrigerant distributor 200. Furthermore, the orifices 5 are provided in the first partition plate 4, and the center of each of the orifices 5 is located between associated adjacent flat tubes 1. Because of provision of such a configuration, the two-phase gas-liquid refrigerant on the upstream side and downstream side of the refrigerant distributor 200 can be mixed and stirred in the first space 36, thereby improving the refrigerant distribution performance.

Furthermore, in order to improve the refrigerant distribution performance, it is important that the difference in pressure loss between an upstream side of the refrigerant distributor 200 that adjoins the upstream side-surface lid 8 (which will be hereinafter also referred to as "first side-surface side side") and a downstream side of the refrigerant distributor 200 that adjoins the downstream side-surface lid 9 (which will be hereinafter also referred to as "side-surface side located opposite to one side-surface side") is small. For this reason, of the spaces in the refrigerant distributor 200 that are isolated from each other by the first partition plate 4, the second space 37 into which the ends of the flat tubes 1 are not inserted is made larger in volume than the first space 36. As a result, the difference in pressure loss between the upstream side and the downstream side of the refrigerant distributor 200 is reduced, the refrigerant distribution performance is improved, and the amount of refrigerant can be reduced. Furthermore, the width of the second space 37 is greater than the height of the second space 37. It is therefore possible to make the refrigerant distributor 200 thinner, and accordingly, increase the heat transfer area of the heat exchanger 100.

Furthermore, the kind of the two-phase gas-liquid refrigerant that flows in the refrigerant distributor 200 is not limited to a particular kind of refrigerant. However, in the case of using refrigerant that is lower in pressure than R410A refrigerant or R32 refrigerant that is commonly and widely used as refrigerant for air conditioners, since the refrigerant is low in gas density, it is possible to more greatly reduce the pressure loss, especially, because of provision of the first partition plate 4.

Furthermore, as examples of refrigerant that flows in the refrigerant distributor 200, low-pressure refrigerants such as olefin refrigerant (such as R1234yf or R1234ze (E)), propane, DME (dimethyl ether), and mixed refrigerant containing any of these refrigerants as one component are present. These refrigerants are low in gas density and can cause the pressure loss to be more greatly reduced by the first partition plate 4.

Alternatively, as the refrigerant that flows in the refrigerant distributor 200, a zeotropic mixed refrigerant having refrigerant components having different boiling points may be used, and in this zeotropic mixed refrigerant, gas and liquid are dispersed by the orifices 5. Thus, the refrigerant distribution is improved, thereby also improving composition distribution, and greatly improving the heat exchanger performance.

As described above, the heat exchanger 100 according to Embodiment 1 includes a plurality of heat transfer tubes and the refrigerant distributor 200 having a tubular shape and having insertion holes 3*a* that are spaced from each other in the first direction, and that are provided as holes into which ends of the heat transfer tubes are inserted in the second direction. Further, the refrigerant distributor 200 includes: a first partition plate 4 that partitions the interior of the refrigerant distributor 200 into the first space 36 into which the ends of the heat transfer tubes are inserted and the second space 37 into which the ends of the heat transfer tubes are not inserted, the second space 37 being larger in volume than the first space 36; and an inflow pipe 10 provided in a one side-surface side and configured to allow two-phase gas-liquid refrigerant to flow into the second space 37. Moreover, the heat transfer tubes are inserted in the insertion holes 3*a* such that the ends of the heat transfer tubes are located apart from the first partition plate 4 in the first space 36. Furthermore, the first partition plate 4 is provided with the orifices 5 that are each provided at a location corresponding to a space between associated adjacent ones of the heat transfer tubes, and that cause the first space 36 and the second space 37 to communicate with each other.

In the heat exchanger 100 according to Embodiment 1, the interior of the refrigerant distributor 200 is partitioned by the first partition plate 4 into a first space 36 into which the ends of the heat transfer tubes are inserted and a second space 37 into which the ends of the heat transfer tubes are not inserted, the second space 37 being larger in volume than the first space 36. Further, the heat transfer tubes are inserted in the insertion holes 3*a* such that the ends of the heat transfer tubes are provided apart from the first partition plate 4 in the first space 36, and the first partition plate 4 is provided with the orifices 5 that are each provided at a location corresponding to a space between associated adjacent ones of the heat transfer tubes, and that cause the first space 36 and the second space 37 to communicate with each other. Because of such a configuration, it is possible to divide a refrigerant flow passage into the first space 36 and the second space 37 and further reduce fluid resistance at connections between the heat transfer tubes and the refrigerant distributor 200 than in the case where the interior of the refrigerant distributor 200 is not divided into two spaces. It is therefore possible to reduce the volume of the refrigerant distributor 200. Furthermore, the first space 36 extends in the first direction, and part of the two-phase gas ejected from the orifice 5 into the space formed by the adjacent heat transfer tubes is mixed. Thus, it is possible to improve the refrigerant distribution performance, and also improve the heat exchanger performance.

Embodiment 2

Regarding Embodiment 2, components that are the same as or equivalent to those in Embodiment 1 will be denoted by same reference signs, and their descriptions will not be repeated if they have already been made.

Figure 5:
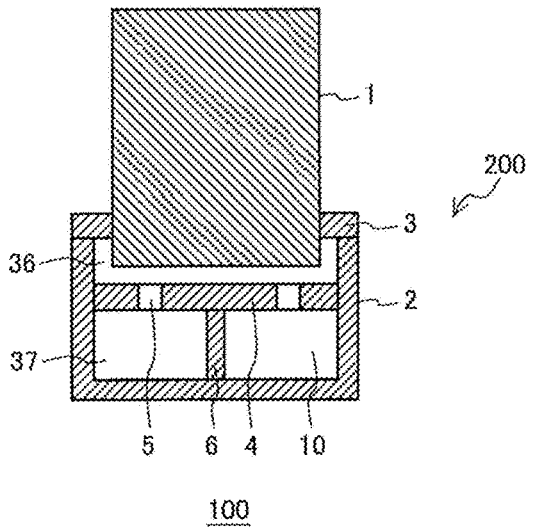
FIG. 5 is an example of a schematic side view of a vertical section of a heat exchanger according to Embodiment 2 of the present disclosure.
Figure 6:
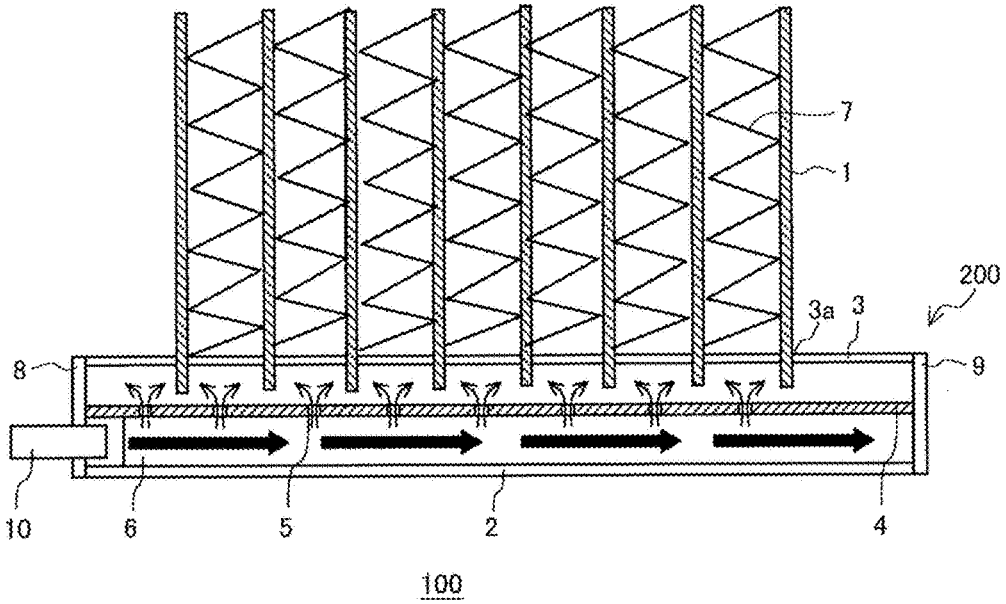
FIG. 6 is an example of a schematic front view of a vertical section of the heat exchanger according to Embodiment 2 of the present disclosure.

FIG. 5 is an example of a schematic side view of a vertical section of a heat exchanger 100 according to Embodiment 2 of the present disclosure. FIG. 6 is an example of a schematic front view of a vertical section of the heat exchanger 100 according to Embodiment 2 of the present disclosure.

In the heat exchanger 100 according to Embodiment 2, as illustrated in FIGS. 5 and 6, the refrigerant distributor 200 includes a second partition plate 6 that is provided on the side adjoining the upstream side-surface lid 8 and that partitions in the width direction the refrigerant flow passage that is the second space 37 defined by the first partition plate 4 and the header outer-pipe bottom plate 2, widthwise.

Next, the flow of two-phase gas-liquid refrigerant that flows in the refrigerant distributor 200 will be described. In FIG. 6, arrows indicate the flow of the two-phase gas-liquid refrigerant.

The two-phase gas-liquid refrigerant flows into the refrigerant distributor 200 through the inflow pipe 10 and flows toward the downstream side-surface lid 9 through a refrigerant flow passage that is the second space 37 defined by the first partition plate 4, the second partition place 6, and the header outer-pipe bottom plate 2. Then, in the process, the refrigerant is atomized at the orifices 5 in turn into the first space 36 defined by the first partition plate 4, the header outer-pipe top plate 3, and the header outer-pipe bottom plate 2. The atomized refrigerant is stirred in spaces defined between adjacent flat tubes 1 and is distributed to the flat tubes 1 in a state in which gas-liquid refrigerant atomized from right and left orifices 5 is homogenized and an imbalance in distribution between the right and left orifices 5 is reduced. After that, the refrigerant flows while evaporating by exchanging heat with outside air in a process in which the refrigerant flows in the flat tubes 1.

Figure 7:
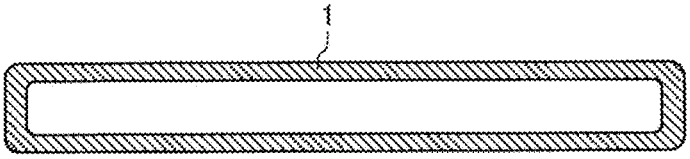
FIG. 7 is a schematic view illustrating an example of a flow passage cross-section of a flat tube of the heat exchanger according to Embodiment 2 of the present disclosure.
Figure 8:
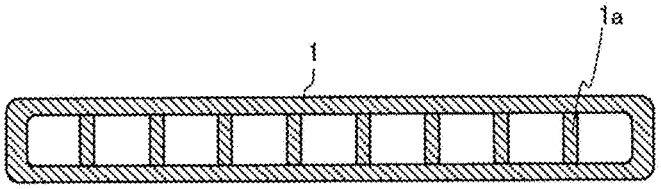
FIG. 8 is a schematic view illustrating an example of a flow passage cross-section of a flat tube of a heat exchanger according to the first modification of Embodiment 2 of the present disclosure.
Figure 9:
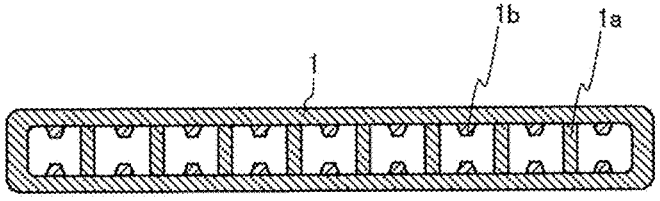
FIG. 9 is a schematic view illustrating an example of a flow passage cross-section of a flat tube of a heat exchanger according to the second modification of Embodiment 2 of the present disclosure.

FIG. 7 is a schematic view illustrating an example of the section of a flow passage in each of flat tubes 1 in the heat exchanger 100 according to Embodiment 2 of the present disclosure. FIG. 8 is a schematic view illustrating an example of the section of a flow passage of each of flat tubes 1 in a heat exchanger 100 according to the first modification of Embodiment 2 of the present disclosure. FIG. 9 is a schematic view illustrating an example of the section of a flow passage in each of flat tubes 1 in a heat exchanger 100 according to the second modification of Embodiment 2 of the present disclosure.

Next, the flat tube 1 according to Embodiment 2 will be described in detail.

The flat tube 1 is a heat transfer tube made of metal such as aluminum, copper, or stainless steel. As illustrated in FIG. 7, the section of the flow passage in the flat tube 1 is rectangular.

As illustrated in FIG. 8, the flat tube 1 may be a flat tube having multiple holes and partition pillars 1*a*. In the flat tube 1, the multiple holes are isolated from each other by the partition pillars 1*a*. In the flat tube 1 having such a configuration, the pressure resistance is improved. Also, the thickness of the flat tube 1 can be reduced.

Furthermore, as illustrated in FIG. 9, the flat tube 1 has partition pillars 1*a* and projecting portions 1*b*. In the flat tube 1, the projection portions 1*b* are arranged along the flow passages such that each of the projection portions 1*b* is located between associated two of the adjacent partition pillars 1*a*. In the flat tube 1 having such a configuration, the heat transfer performance can be improved. In addition, the thickness of the flat tube 1 can be reduced.

Figure 10:
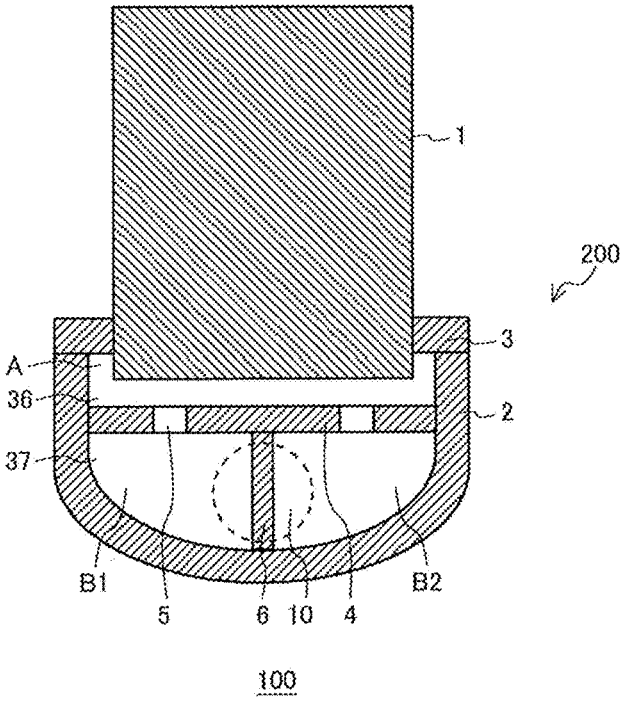
FIG. 10 is an example of a schematic side view of a vertical section of a heat exchanger according to the third modification of Embodiment 2 of the present disclosure.

FIG. 10 is an example of a schematic side view of a vertical section of a heat exchanger 100 according to the third modification of Embodiment 2 of the present disclosure.

As illustrated in FIG. 10, the refrigerant distributor 200 may be formed into a substantially D shape such that the header outer-pipe bottom plate 2 is R-shaped. Because the refrigerant distributor 200 has such a shape, the pressure resistance of the header outer-pipe bottom plate 2 is improved, as compared with the refrigerant distributor 200 having a rectangular shape, and accordingly, the wall thickness of the header outer-pipe bottom plate 2 can be reduced. Furthermore, since the header outer-pipe top plate 3 has a linear portion, the flat tubes 1 can be easily brazed, and the amounts of insertion of the flat tubes 1 can be reduced.

Furthermore, it is appropriate to establish B1+B2>A, where A is an effective area of a section defined by the header outer-pipe top plate 3, the first partition plate 4, and the header outer-pipe bottom plate 2, and B1 and B2 are effective areas of sections defined by the first partition plate 4, the second partition plate 6, and the header outer-pipe bottom plate 2. In this configuration, of the total area of the sections of the flow passages provided in the refrigerant distributor 200, large areas are assigned to sections of right and left refrigerant flow passages located on a lower side, and it is possible to reduce an increase in pressure losses in the right and left refrigerant flow passages, and thus improve the refrigerant distribution performance.

Figure 11:
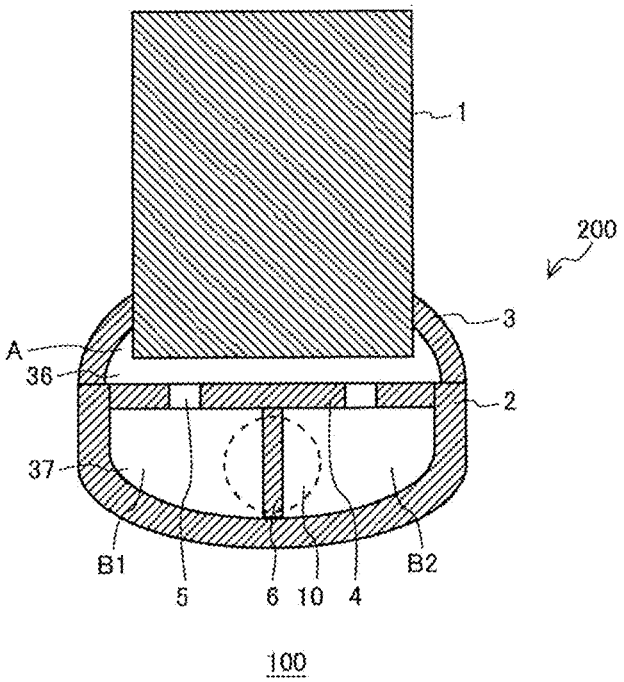
FIG. 11 is an example of a schematic side view of a vertical section of the heat exchanger according to Embodiment 2 of the present disclosure.

FIG. 11 is an example of a schematic side view of a vertical section of the heat exchanger 100 according to Embodiment 2 of the present disclosure.

As illustrated in FIG. 11, the header outer-pipe top plate 3 of the refrigerant distributor 200 may be formed into a distorted semicircular shape. Because the header outer-pipe top plate 3 has such a shape, the pressure resistance is improved, as compared with the header outer-pipe top plate 3 having a linear shape, and accordingly, it is possible to reduce the wall thickness of the header outer-pipe top plate 3. Moreover, since the wall thickness of the header outer-pipe top plate 3 can be made smaller than the wall thickness of the header outer-pipe bottom plate 2, the volume of material can be reduced.

Also, in the configuration as illustrated FIG. 11, it is appropriate to establish B1+B2>A, where A is an effective area of a section defined by the header outer-pipe top plate 3 and the first partition plate 4, and B1 and B2 are effective areas of sections defined by the first partition plate 4, the second partition plate 6, and the header outer-pipe bottom plate 2. In this configuration, of the total area of sections of flow passages provided in the refrigerant distributor 200, large areas can be allocated to sections of right and left refrigerant flow passages located on the lower side, and accordingly, makes it possible to reduce an increase in pressure losses in the right and left refrigerant flow passages, and the refrigerant distribution performance can be improved.

Figure 12:
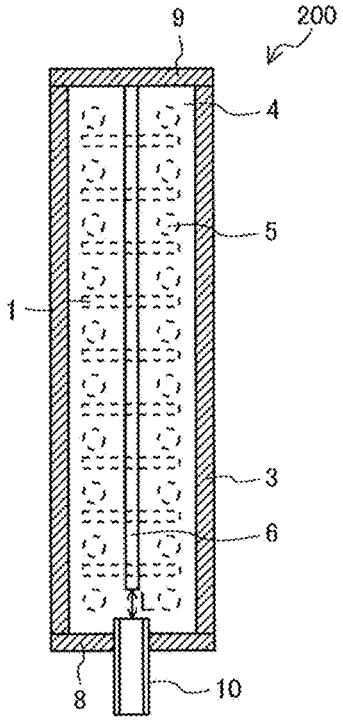
FIG. 12 is an example of a schematic plan view of a cross section of a refrigerant distributor of the heat exchanger according to Embodiment 2 of the present disclosure.

FIG. 12 is an example of a schematic plan view of a section of a refrigerant distributor 200 of the heat exchanger 100 according to Embodiment 2 of the present disclosure.

Figure 13:
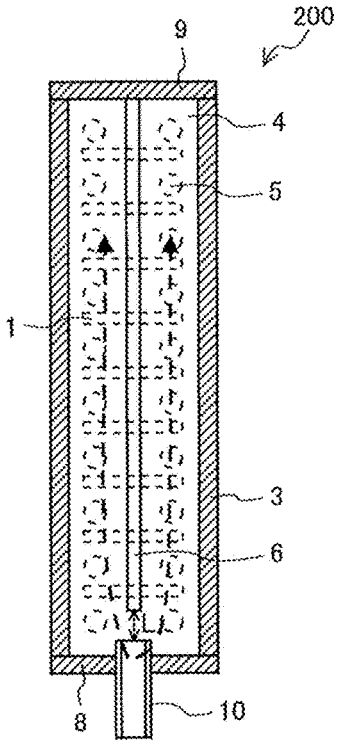
FIG. 13 is a diagram illustrating the flow of refrigerant in the interior of the refrigerant distributor as illustrated in FIG. 12.

FIG. 13 is a diagram illustrating the flow of refrigerant in the refrigerant distributor 200 as illustrated in FIG. 12.

As illustrated in FIG. 12, each of the orifices 5 is provided between associated adjacent flat tubes 1, and the orifices 5 are provided above the right and left refrigerant flow passages isolated from each other by the second partition plate 6. Furthermore, the second partition plate 6 has an upstream end that is spaced from the inflow pipe 10, whereby refrigerant that has flowed into the interior of the refrigerant distributor 200 through the inflow pipe 10 divides into two streams to flow into respective flow passages. The second partition plate 6 and the inflow pipe 10 are separated from each other by a distance L.

Next, the flow of refrigerant in the refrigerant distributor 200 will be described with reference to FIG. 13.

The two-phase gas-liquid refrigerant that flows through the inflow pipe 10 is distributed to the right and left refrigerant flow passages at the upstream end of the second partition plate 6. Then, the refrigerant passes through the orifices 5 provided above the refrigerant flow passages, is atomized and stirred, and is then distributed to the first space 36 defined by the header outer-pipe top plate 3, the first partition plate 4, and the header outer-pipe bottom plate 2. Therefore, the refrigerants that have flowed through the respective refrigerant flow passages, that is, the right and left refrigerant flow passages, join each other in the first space 36 defined by the header outer-pipe top plate 3, the first partition plate 4, and the header outer-pipe bottom plate 2. In this case, in the case where the orifices 5 are provided such that center positions of the orifices 5 are each located between associated adjacent flat tubes 1, the refrigerants that have flowed out of the right and left refrigerant passages are easily homogenously mixed in the first space 36, thus greatly improving the refrigerant distribution performance. Because of provision of the above configuration, it is possible to reduce an imbalance between the right and left liquid refrigerants in the refrigerant distributor 200.

Furthermore, since the second partition plate 6 is provided, in the case where the section of a flow passage that is the second space 37 is closer to a regular square shape, whereby a flow regime easily changes to an annular flow or a churn flow in which much gas refrigerant flows in the vicinity of the center of a tube in the refrigerant distributor 200. This increases the ranges of the flow rate and quality of refrigerant that are effective in improvement of the refrigerant distribution performance through atomization at the orifices 5. Thus, the range in which the refrigerant distribution performance can be improved through atomization at the orifices 5 can be widened.

In Embodiment 2, the connecting location of the inflow pipe 10 and the following distance are not limited; however, according to the inventors' experiments, it is preferable that the distance L between an insertion end of the inflow pipe 10 and the second partition plate 6 be greater than or equal to the inner diameter of the inflow pipe 10. This is because in this case, the pressure loss is relatively small.

Furthermore, the refrigerant distributor 200 may be configured such that the right and left refrigerant flow passages are provided to have different sectional areas. In this case, the refrigerant distributor 200 can be set such that a flow passage having a large sectional area is located on a windward side and a flow passage having a small sectional area is located on a leeward side. Furthermore, much refrigerant can be distributed to the windward side where the temperature difference between refrigerant and air is great and the amount of heat exchange is large. It is therefore possible to improve the heat exchange efficiency.

Furthermore, although Embodiment 2 is described above referring to the case where the refrigerant distributor 200 is provided with a single inflow pipe 10, the refrigerant distributor 200 may be provided with a plurality of inflow pipes 10. In this case, it is appropriate that for example, valves or flow regulating capillary tubes are provided upstream of the inflow pipes 10. In this case, without the need to distribute the refrigerant to the right and left refrigerant flow passages using the second partition plate 6 in the refrigerant distributor 200, it is possible to distribute the refrigerant to the right and left refrigerant flow passages and adjust the flow rates of refrigerants that flow through the right and left refrigerant flow passages. Accordingly, it is possible to improve the controllability for refrigerant flow. Furthermore, bifurcated tubes can be used as the inflow pipes 10. In this case, it possible to distribute the refrigerant to the right and left refrigerant flow passages at low cost/

Figure 14:
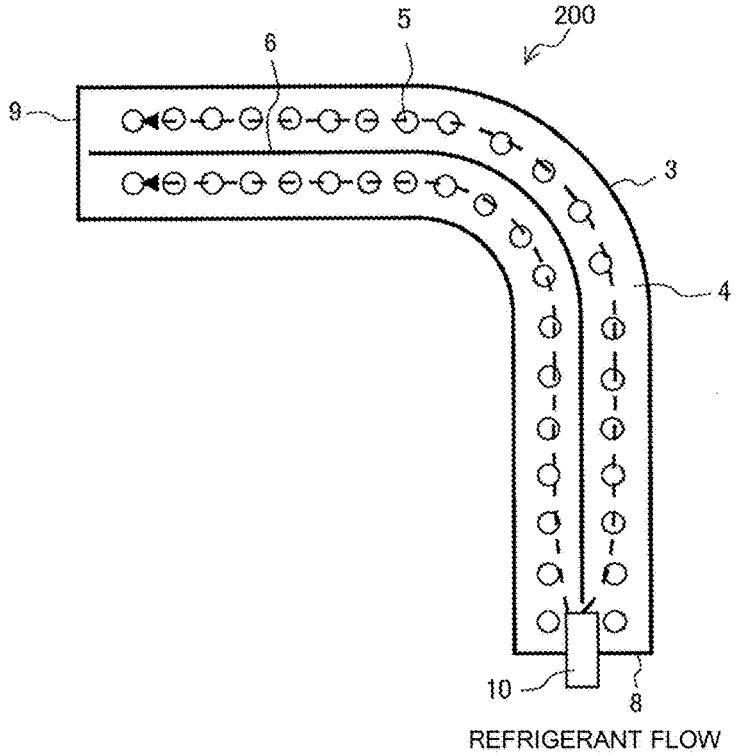
FIG. 14 is an example of a schematic plan view of a cross section of an L-shaped bent refrigerant distributor of the heat exchanger according to Embodiment 2 of the present disclosure.
Figure 15:
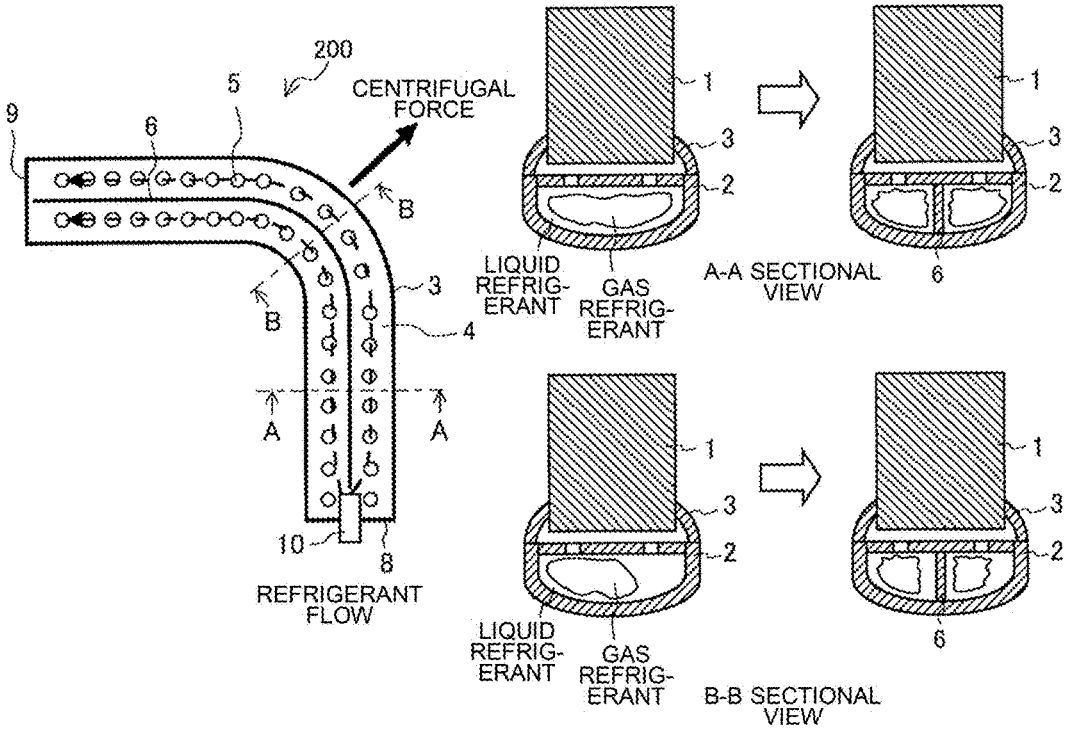
FIG. 15 is a diagram explaining a vertical section of the refrigerant distributor as illustrated in FIG. 14.

FIG. 14 is an example of a schematic plan view of a cross section of an L-shaped refrigerant distributor 200 of the heat exchanger 100 according to Embodiment 2 of the present disclosure. FIG. 15 is a diagram explaining a vertical section of the refrigerant distributor 200 as illustrated in FIG. 14.

As illustrated in FIG. 14, in the case where the refrigerant distributor 200 is L-shaped (but does not need to be strictly L-shaped) from the first direction to the third direction, and the second partition plate 6 is provided in the refrigerant distributor 200, it is possible to reduce an imbalance in liquid refrigerant due to a centrifugal force when the two-phase gas-liquid refrigerant flows through the bent part of the distributor, and thus to improve the heat exchange efficiency. Furthermore, as illustrated in FIG. 15, even in the case where the refrigerant distributor 200 is not L-shaped, by providing the second partition plate 6 in the refrigerant distributor 200, the flow regime of refrigerant that flows through the refrigerant flow passage easily changes to an annular flow or a churn flow. Thus, the range in which the refrigerant distribution performance can be improved through atomization at the orifices 5 is widened. Although Embodiment 2 is described above referring to the case where an example of the flow regime of refrigerant is an annular flow or a churn flow, this is not limiting, for example, the example of the flow regime of refrigerant may be a slug flow, a laminar flow, or a bubble flow.

Figure 16:
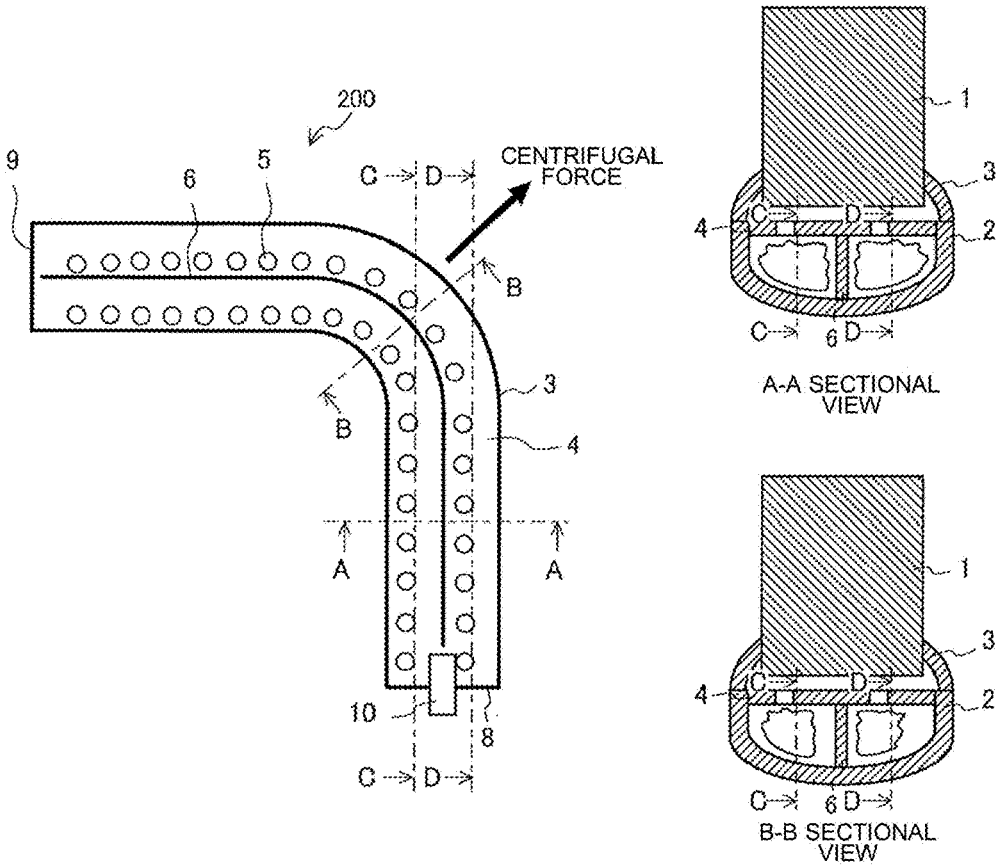
FIG. 16 is a diagram explaining a vertical sectional view of a modification of the refrigerant distributor as illustrated in FIG. 14.
Figure 17:
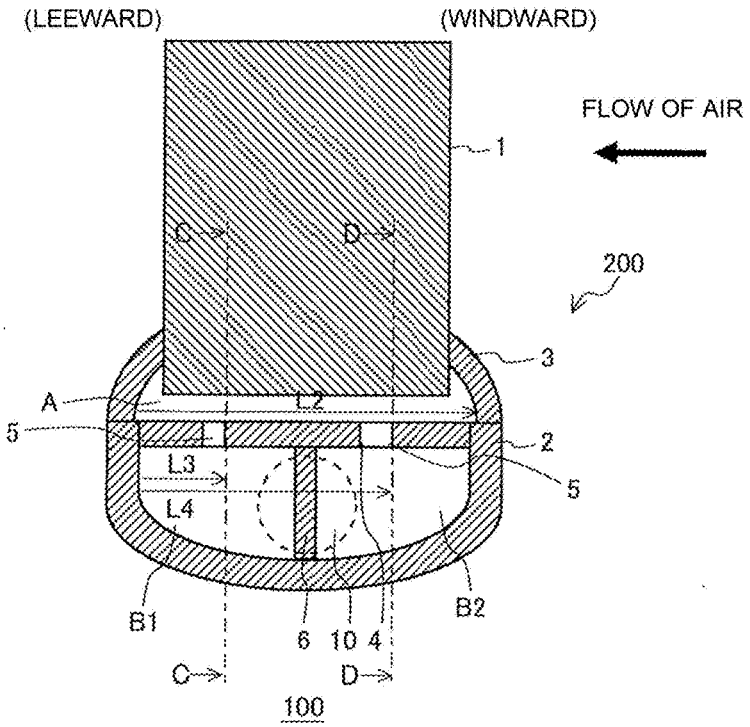
FIG. 17 is an example of a schematic side view of a vertical section of a heat exchanger according to the fourth modification of Embodiment 2 of the present disclosure.

FIG. 16 is a diagram explaining a vertical sectional view of a modification of the refrigerant distributor 200 as illustrated in FIG. 14. FIG. 17 is an example of a schematic side view of a vertical section of a heat exchanger 100 according to the fourth modification of Embodiment 2 of the present disclosure.

As illustrated in FIG. 16, the centers of the orifices 5 provided in the first partition plate 4 may be displaced from the respective center lines (C-C and D-D) of the right and left refrigerant flow passages in an opposite direction to a direction in which a centrifugal force acts as indicated by an arrow in FIG. 16. In such a configuration, the orifices 5 are provided in such a manner as to avoid a region in bent part of the refrigerant distributor in which liquid refrigerant stays, and liquid refrigerant and gas refrigerant can be stably ejected from the orifices 5, thereby improving the refrigerant distribution performance.

It is assumed that where regarding the center lines C-C and D-D of the right and left refrigerant flow passages, as illustrated in FIG. 17, where L2 is the width of the first partition plate 4, the distance L3 between the center line C-C and a leeward (left) inside surface of the header outer-pipe bottom plate 2 satisfies ¼×L2. Also, it is assumed that the distance L4 between the center line D-D and the leeward (left) inside surface of the header outer-pipe bottom plate 2 satisfies ¾×L2.

In FIG. 17, a black arrow indicates the direction of flow of air that passes through the flat tube 1, and in such a case, the temperature difference between air and refrigerant in a windward region in the flat tube 1 is great, and the amount of heat exchanger is thus large. Therefore, in the case where the inner diameter of an orifice 5 above a windward one of the right and left refrigerant flow passages, that is, the right refrigerant flow passage as illustrated in FIG. 17, is made greater than the inner diameter of an orifice 5 above the leeward (left) refrigerant flow passage, in the distribution of the refrigerant, it is possible to supply a larger amount of liquid refrigerant to a region where the temperature difference between refrigerant and air is great.

Regarding Embodiment 2, the fins of the heat exchanger 100 are descried above as the corrugated fin 7, but this description is not limiting. For example, another kind of fins such as plate fins may be used as the fins of the heat exchanger 100.

As described above, in the heat exchanger 100 according to Embodiment 2, the refrigerant distributor 200 includes a second partition plate 6 that partitions the second space 37 in the third direction into two refrigerant flow passages in the second space 37.

In the heat exchanger 100 according to Embodiment 2, the second partition plate 6 is provided in the refrigerant distributor 200. Therefore, the flow regime of refrigerant that flows in the flow passage changes to an annular flow or a churn flow, and the refrigerant distribution performance through atomization by the orifices 5 can be more greatly improved.

In the heat exchanger 100 according to Embodiment 2, the inflow pipe 10 and the second partition plate 6 are spaced from each other. In the heat exchanger 100 according to Embodiment 2, refrigerant that has flowed into the refrigerant distributor 200 through the inflow pipe 10 branches into two flows to flow through the two flow passages.

Furthermore, in the heat exchanger 100 according to Embodiment 2, the distance between the inflow pipe 10 and the second partition plate 6 is greater than or equal to the inner diameter of the inflow pipe 10. The heat exchanger 100 according to Embodiment 2, it is possible to decrease a pressure loss to a relatively small value.

In addition, in the heat exchanger 100 according to Embodiment 2, the refrigerant distributor 200 is bent to be L-shaped. In the heat exchanger 100 according to Embodiment 2, the second partition plate 6 is provided in the refrigerant distributor 200, whereby when the two-phase gas-liquid refrigerant flows through the bent part, one-sided flow of the liquid refrigerant due to a centrifugal force is reduced, and the heat exchange efficiency is thus improved.

Embodiment 3

Embodiment 3 of the present disclosure will be described. Regarding Embodiment 3, components that are the same as or equivalent to those in Embodiment 1 and/or Embodiment 2 will be denoted by same reference signs, and their descriptions will not be repeated if they have already been made FIG. 18 is an example of a schematic plan view of a cross section of a refrigerant distributor 200 of a heat exchanger 100 according to Embodiment 3 of the present disclosure.

Figure 18:
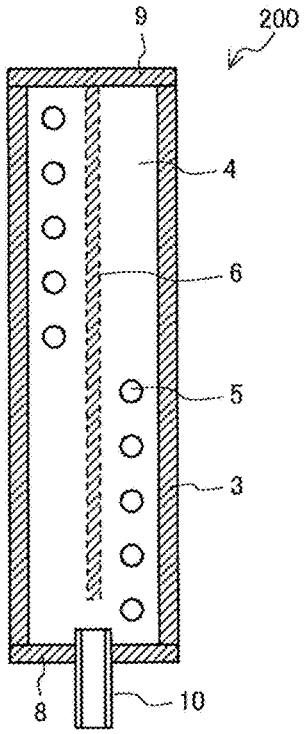
FIG. 18 is an example of a schematic plan view of a cross section of a refrigerant distributor of a heat exchanger according to Embodiment 3 of the present disclosure.

In the heat exchanger 100 according to Embodiment 3, as illustrated in FIG. 18, in the first partition plate 4 of the refrigerant distributor 200, a plurality of orifices 5 are provided such that in each of spaces between adjacent flat tubes, a single orifice 5 is located above only one of the right and left refrigerant flow passages. To be more specific, above the right refrigerant flow passage, orifices 5 are provided only in a region close to the upstream side-surface lid 8, and above the left refrigerant flow passage, orifices 5 are provided only in a region close to the downstream side-surface lid 9.

Because of provision of such a configuration, in the right refrigerant flow passage, a sufficient space is ensured on the downstream side, thereby reducing disturbance of refrigerant that occurs when the refrigerant collides with the downstream side-surface lid 9.

Figure 19:
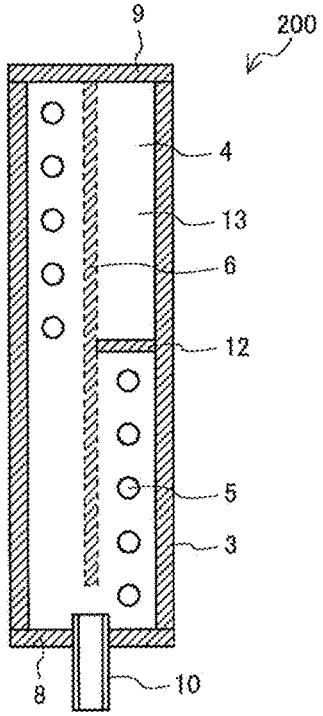
FIG. 19 is an example of a schematic plan view of a cross section of a refrigerant distributor of a heat exchanger according to a modification of Embodiment 3 of the present disclosure.

FIG. 19 is an example of a schematic plan view of a cross section of a refrigerant distributor 200 of a heat exchanger 100 according to a modification of Embodiment 3 of the present disclosure.

As illustrated in FIG. 19, a flow passage closing plate 12 configured to close a refrigerant flow passage may be provided in the middle of the right refrigerant flow passage. To be more specific, in the right refrigerant flow passage, the flow passage closing plate 12 may be provided downstream of the most downstream one of the orifices 5. In this configuration, in part of the right refrigerant flow passage, a sealed space 13 through which no refrigerant flows can be provided, and it is therefore possible to reduce the amount of refrigerant with which the refrigerant flow passage is charged.

As noted above, in the heat exchanger 100 according to Embodiment 3, in each of the spaces between adjacent heat transfer tubes, one orifice 5 is provided above only one of the two refrigerant flow passages; and above one of the refrigerant flow passages, orifices 5 are provided on a side surface side opposite to one side surface side, and above the other refrigerant flow passage, orifices 5 are provided on the above one side surface side.

In the heat exchanger 100 according to Embodiment 3, in one of the refrigerant flow passages, a sufficient space is ensured o the downstream side, and it is therefore possible to reduce disturbance of refrigerant that occurs when the refrigerant collides with the downstream side-surface lid 9.

Furthermore, in the heat exchanger 100 according to Embodiment 3, in the refrigerant distributor 200, the flow passage closing plate 12 is provided in the middle of one of the two refrigerant flow passages to close the refrigerant flow passage. Also, the flow passage closing plate 12 is provided closer to the side-surface side opposite to the one side-surface side than one of the orifices 5 that is the closest to the side-surface side opposite to the one side-surface side.

In the heat exchanger 100 according to Embodiment 3, in part of the right refrigerant flow passage, a sealed space 13 through which no refrigerant flows is provided, thereby reducing the amount of refrigerant with which the refrigerant flow passage is changed.

Embodiment 4

Embodiment 4 of the present disclosure will be described. Regarding Embodiment 4, components that are the same as or equivalent to those in any of Embodiments 1 to 3 will be denoted by same reference signs, and their descriptions will not be repeated if they have already been made.

Figure 20:
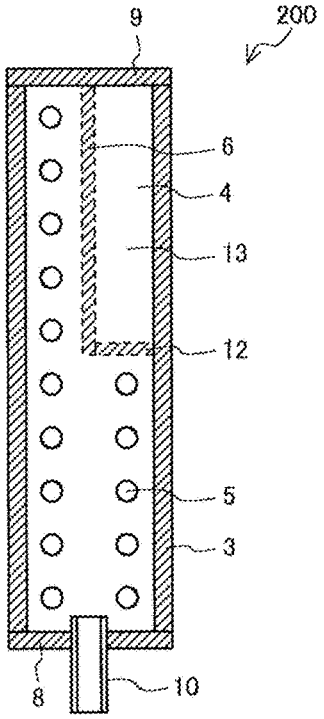
FIG. 20 is an example of a schematic plan view of a cross section of a refrigerant distributor of a heat exchanger according to Embodiment 4 of the present disclosure.

FIG. 20 is an example of a schematic plan view of a cross section of a refrigerant distributor 200 of a heat exchanger 100 according to Embodiment 4 of the present disclosure.

In the heat exchanger 100 according to Embodiment 4, as illustrated in FIG. 20, the second partition plate 6 is provided only in a downstream area. In such a configuration, it is possible to distribute refrigerant without using a partition on the upstream side where the flow rate of refrigerant is high and the flow regime easily changes to an annular flow or a churn flow. Furthermore, since the second partition plate 6 and the flow passage closing plate 12 are provided in a region in which the flow rate of refrigerant is low and the flow regime changes to a separated flow such as a slug flow or a wavy flow, the sectional area of the flow passage is reduced, and the flow velocity of the refrigerant is increased. Therefore, the flow regime can be caused to easily change to an annular flow or a churn flow and can be easily maintained. In addition, even in the case where the refrigerant distributor 200 is bent to be L-shaped in a region where the second partition plate 6 is present, it is possible to reduce deterioration of refrigerant distribution that is caused by the bending.

Figure 21:
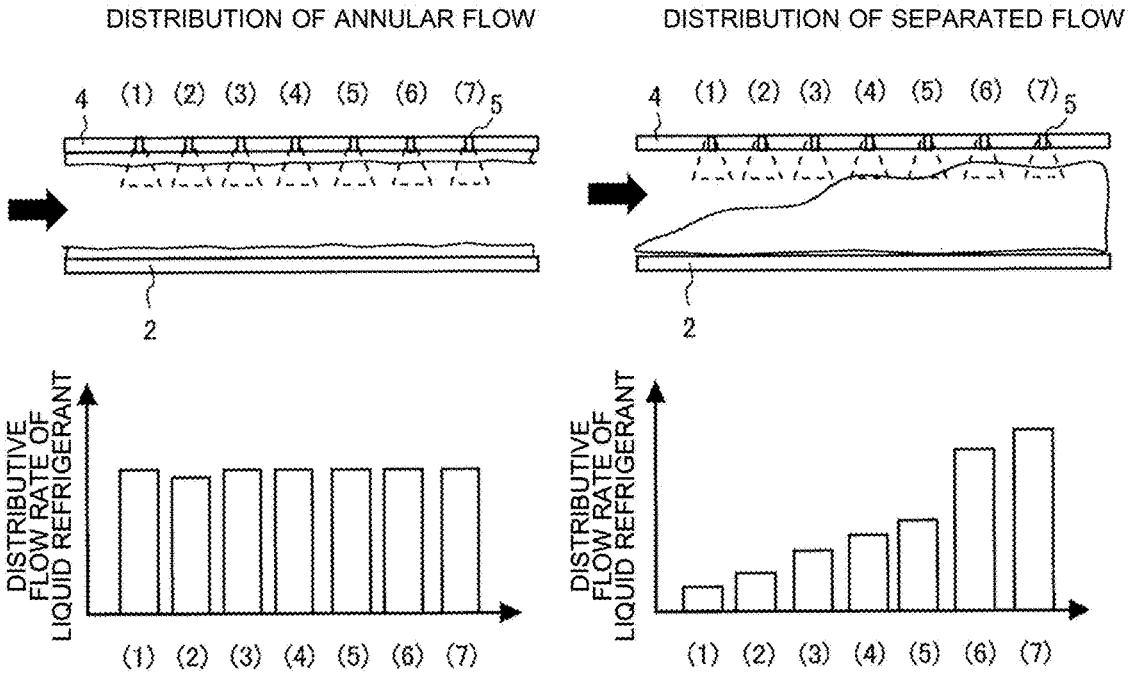
FIG. 21 is a schematic characteristic diagram of distribution of refrigerant by a first partition plate of the refrigerant distributor of the heat exchanger according to Embodiment 4 of the present disclosure.

FIG. 21 is a schematic characteristic diagram of distribution of refrigerant by a first partition plate 4 of the refrigerant distributor 200 of the heat exchanger 100 according to Embodiment 4 of the present disclosure. It should be noted that FIG. 21 illustrates a schematic characteristic diagram of distribution of refrigerant by the first partition plate 4 in an annular flow and a separated flow as measured based on the inventors' experiments. Furthermore, the areas surrounded by dotted lines represent areas of refrigerant that are distributed to the orifices 5. The numbers parenthesized in FIG. 21 associate the orifices 5 and graphs with each other.

As can be seen from FIG. 21, in a flow, such as an annular flow (or a churn flow), in which a larger amount of gas refrigerant flows in the vicinity of the center of the refrigerant flow passage and a larger amount of liquid refrigerant flows in the vicinity of a wall surface of the refrigerant flow passage, a liquid membrane is relatively stable, whereby the liquid refrigerant can be nearly equally distributed. By contrast, in a separated flow, liquid refrigerant and gas refrigerant separate from each other to flow into upper and lower regions of the refrigerant flow passage, as a result of which the refrigerant from the orifices 5 is non-uniformly distributed.

Therefore, a determination as to whether the flow regime is an annular flow or a churn flow is made, for example, based on a modified Baker diagram. Furthermore, the sectional area of the flow passage is defined by the second partition plate 6 such that at an inlet of a region in which the refrigerant flow passage is narrowed, refrigerant assumes a flow regime, such as an annular flow or a churn flow, in which a large amount gas refrigerant flows in the vicinity of the center of the refrigerant flow passage.

As described above, in the heat exchanger 100 according to Embodiment 4, the second partition plate 6 is provided only in a region close to the side-surface side that is located opposite to the one side-surface side. In the heat exchanger 100 according to Embodiment 4, it is possible to distribute refrigerant without using a partition on the upstream side where the flow rate of refrigerant is high and the flow regime easily changes to an annular flow or a churn flow.

Embodiment 5

Embodiment 5 of the present disclosure will be described. Regarding Embodiment 5, components that are the same as or equivalent to those in any of Embodiments 1 to 4 will be denoted by same reference signs, and their descriptions will not be repeated if they have already been made.

Figure 22:
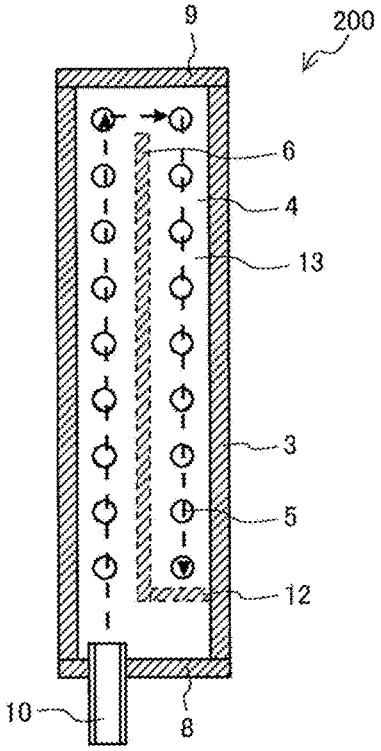
FIG. 22 is an example of a schematic plan view of a cross section of a refrigerant distributor of a heat exchanger according to Embodiment 5 of the present disclosure.

FIG. 22 is an example of a schematic plan view of a cross section of a refrigerant distributor 200 of a heat exchanger 100 according to Embodiment 5 of the present disclosure.

In the heat exchanger 100 according to Embodiment 5, as illustrated in FIG. 22, a flow passage closing plate 12 configured to close a refrigerant flow passage is provided in the middle of the right refrigerant flow passage. To be more specific, the flow passage closing plate 12 is provided upstream of the most upstream orifice 5 in the right refrigerant flow passage. Furthermore, a space is provided between the second partition plate 6 and the downstream side-surface lid 9, and the right and left refrigerant flow passages separated from each other by the second partition plate 6 of the refrigerant distributor 200 continuously communicate with each other on the downstream side. Moreover, as indicated by arrows in the figure, the two-phase gas-liquid refrigerant turns back, on the downstream side, to flow from the left refrigerant flow passage to the right refrigerant flow passage. Because of such a configuration, it is possible to reduce deterioration of refrigerant distribution that occurs due to the collision of the refrigerant with the downstream side-surface lid 9 on the downstream side and deterioration of refrigerant distribution in the case where the flow regime changes to a separated flow.

Figure 23:
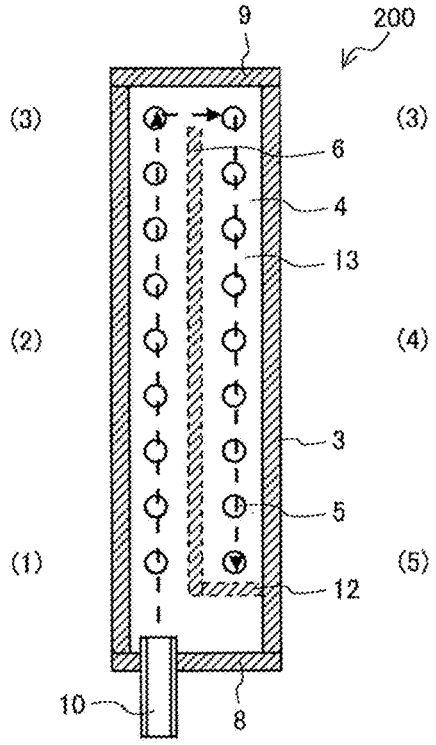
FIG. 23 is a diagram explaining the characteristics of distribution of refrigerant by the refrigerant distributor of the heat exchanger according to Embodiment 5 of the present disclosure.

FIG. 23 is a diagram explaining the characteristics of distribution of refrigerant by the refrigerant distributor 200 of the heat exchanger 100 according to Embodiment 5 of the present disclosure. The numbers parenthesized in FIG. 23 are examples of numbers that simply represent rough characteristics of a refrigerant distribution ratio, for example, in the flow regime of a separated flow.

As illustrated in FIG. 23, in a separated flow region, the liquid refrigerant tends to be one-sided on the downstream side, and the liquid refrigerant is distributed at a ratio of 1:2:3 from the upstream side of the left refrigerant flow passage. Next, at the second partition plate 6, the liquid refrigerant turns back to the right refrigerant flow passage, and the liquid refrigerant is thus distributed at a ratio of 3:4:5 from the downstream side of the right refrigerant flow passage. In such refrigerant flow passages, although the distribution ratios at the orifices 5 above each refrigerant flow passage are uneven, as viewed in the cross sections of the flow passages, the sum of the distribution ratios of liquid refrigerant at the left refrigerant flow passage and the distribution ratios of liquid refrigerant at the right refrigerant flow passage is constant in regions in the first direction. It is therefore possible to reduce unevenness of distribution and improve the distribution, and further widen the range in which the refrigerant distribution performance can be improved.

Although Embodiment 5 is described above by referring to by way of example a flow condition in which a separated flow is made as a flow regime, it is not limiting. That is, it can be expected to improve distribution in any flow regime and any flow condition such as an annular flow and a churn flow.

As described above, in the heat exchanger 100 according to Embodiment 5, the flow passage closing plate 12 is provided closer to the one side-surface side than one of the orifices 5 that is the closest to the one side-surface side, and a space is provided between the second partition plate 6 and a side-surface side that is opposite to the one side-surface side.

In the heat exchanger 100 according to Embodiment 5, it is possible to reduce deterioration of refrigerant distribution that is caused by the collision of the refrigerant with the downstream side-surface lid 9 on the downstream side, and also reduce deterioration of refrigerant distribution in the case where a separated flow is made as the flow regime. Furthermore, although the distribution ratios at the orifices 5 above each refrigerant flow passage are uneven, as viewed in the cross sections of the flow passages, the sum of the distribution ratios of liquid refrigerant at the left refrigerant flow passage and the distribution ratios of liquid refrigerant at the right refrigerant flow passage is constant in regions in the first direction. Thus, it is possible to reduce unevenness of distribution, and in addition to expand the range in which the refrigerant distribution performance can be improved.

Embodiment 6 of the present disclosure will be described. Regarding Embodiment 6, components that are the same as or equivalent to those in any of Embodiments 1 to 5 will be denoted by same reference signs, and their descriptions will not be repeated if they have already been made.

Figure 24:
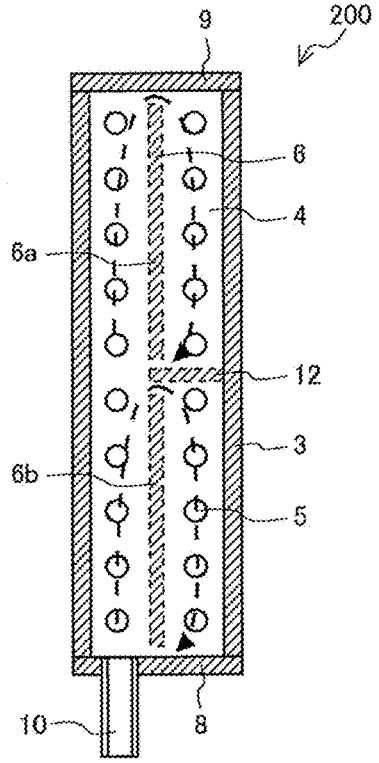
FIG. 24 is an example of a schematic plan view of a cross section of a refrigerant distributor of a heat exchanger according to Embodiment 6 of the present disclosure.

FIG. 24 is an example of a schematic plan view of a cross section of a refrigerant distributor 200 of a heat exchanger 100 according to Embodiment 6 of the present disclosure.

In the heat exchanger 100 according to Embodiment 6, as illustrated in FIG. 24, the second partition plate 6 includes two plates. To be more specific, an upstream second partition plate 6*a* (hereinafter also referred to as "first plate") configured to partition a refrigerant flow passage in the width direction is provided in an upstream region in the refrigerant distributor 200. Also, a downstream second partition plate 6*b* (hereinafter also referred to as "second plate") configured to partition the refrigerant flow passage in the width direction is provided in a downstream region in the refrigerant distributor 200. Further, in part of the right refrigerant flow passage, and to be more specific, in the right refrigerant flow passage, in a space between the upstream second partition plate 6*a* and the downstream second partition plate 6*b*, a flow passage closing plate 12 is provided, with gaps interposed between the upstream second partition plate 6*a* and the flow passage closing plate 12 and between the downstream second partition plate 6*b* and the flow passage closing plate 12. Moreover, since the refrigerant flows through the gaps between the upstream second partition plate 6*a* and the flow passage closing plate 12 and between the downstream second partition plate 6*b* and the flow passage closing plate 12, the refrigerant comes to circulate through right and left refrigerant flow passages on both the upstream side and the downstream side as indicated by arrows in FIG. 24.

Because of provision of the above configuration, it is possible to cause an annular flow in the case where the flow rate of refrigerant is high, and reduce one-sided flow of liquid refrigerant, for example, at a location where collision occurs. Furthermore, even in the case where the refrigerant distributor 200 is bent to be L-shaped, it is possible to reduce deterioration of refrigerant distribution that is caused by such bending.

Figure 25:
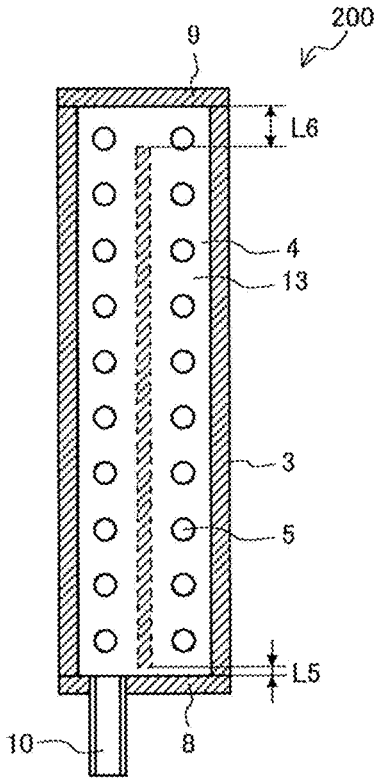
FIG. 25 is an example of a schematic plan view of a cross section of a refrigerant distributor of a heat exchanger according to the first modification of Embodiment 6 of the present disclosure.

FIG. 25 is an example of a schematic plan view of a cross section of a refrigerant distributor 200 of a heat exchanger 100 according to the first modification of Embodiment 6 of the present disclosure.

As illustrated in FIG. 25, the second partition plate 6 may include a single plate, not two plates. In this case, the flow passage closing plate 12 is not provided. Furthermore, gaps are provided between the second partition plate 6 and the upstream side-surface lid 8 and between the second partition plate 6 and the downstream side-surface lid 9. In order to stabilize an annular flow, it is preferable that a relationship between the gap L5 between the second partition plate 6 and the upstream side-surface lid 8 and the gap L6 between the second partition plate 6 and the downstream side-surface lid 9 satisfy L5<L6.

Figure 26:
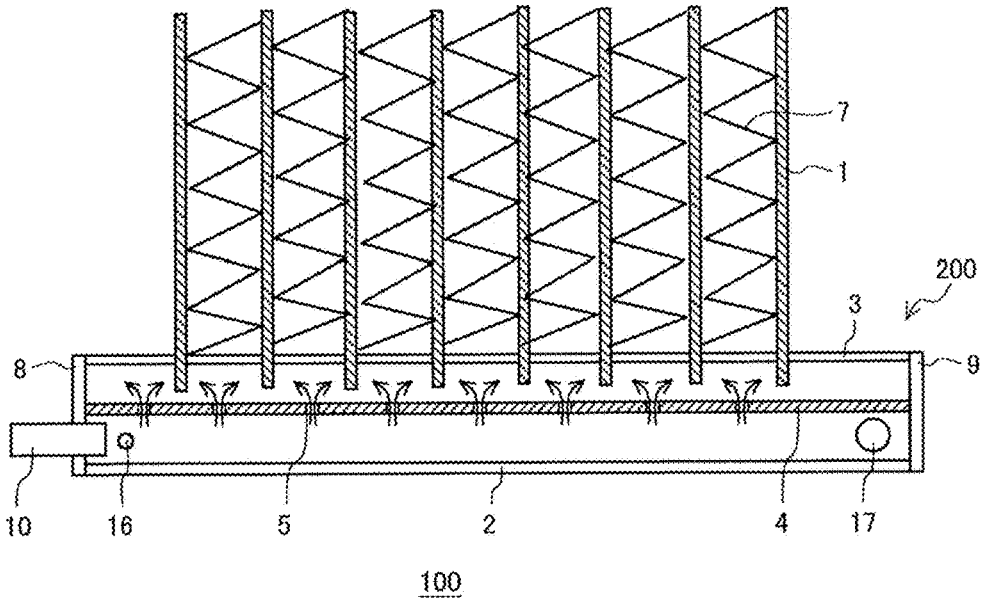
FIG. 26 is an example of a schematic front view of a vertical section of a heat exchanger according to the second modification of Embodiment 6 of the present disclosure.

FIG. 26 is an example of a schematic front view of a vertical section of a heat exchanger 100 according to the second modification of Embodiment 6 of the present disclosure.

In Embodiment 6, annular flow passages are provided using the gaps. However, the annular flow passages are described as an example, that is, this description is not limiting. For example, as illustrated in FIG. 26, an annular flow passage may be provided by forming first and second right-left through-holes 16 and 17 in part of the second partition plate 6, instead of providing the gaps.

As described above, in the heat exchanger 100 according to Embodiment 6, the second partition plate 6 includes a first plate provided close to the one side-surface side and a second plate provided close to the side-surface side located opposite to the one side-surface side. Furthermore, the gaps are provided between the first plate and the second plate, between the first plate and the one side-surface side, and between the second plate and the side-surface side located opposite to the one side-surface side. Furthermore, the flow passage closing plate 12 is provided in the gap between the first plate and the second plate and apart from the first plate and the second plate.

In the heat exchanger 100 according to Embodiment 6, it is possible to cause an annular flow in the case where the flow rate of refrigerant is high, and to reduce one-sided flow of liquid refrigerant, for example, at a location where collision occurs. Furthermore, even in the case where the refrigerant distributor 200 is bent to be L-shaped, it is possible to reduce deterioration of refrigerant distribution that is caused by such bending.

Furthermore, in the heat exchanger 100 according to Embodiment 6, the gaps are provided between the second partition plate 6 and the one side-surface side and between the second partition plate 6 and the side-surface side located opposite to the one side-surface side. Furthermore, the gap between the second partition plate 6 and the side-surface side located opposite to the one side-surface side is larger than the gap between the second partition plate 6 and the one side-surface side.

Alternatively, in the heat exchanger 100 according to Embodiment 6, the second partition plate 6 is provided to extend from the one side-surface side to the side-surface side located opposite to the one side-surface side, and beside the second partition plate 6, openings are provided on the one side-surface side and the side-surface side located opposite to the one side-surface side as openings through each of which refrigerant passes. Moreover, the opening provided on the side-surface side located opposite to the one side-surface side is larger than the opening provided on the one side-surface side.

In the heat exchanger 100 according to Embodiment 6, it is possible to stabilize an annular flow.

Embodiment 7 of the present disclosure will be described. Regarding Embodiment 7, components that are the same as or equivalent to those in any of Embodiments 1 to 6 will be denoted by same reference signs, and their descriptions will not be repeated if they have already been made.

Figure 27:
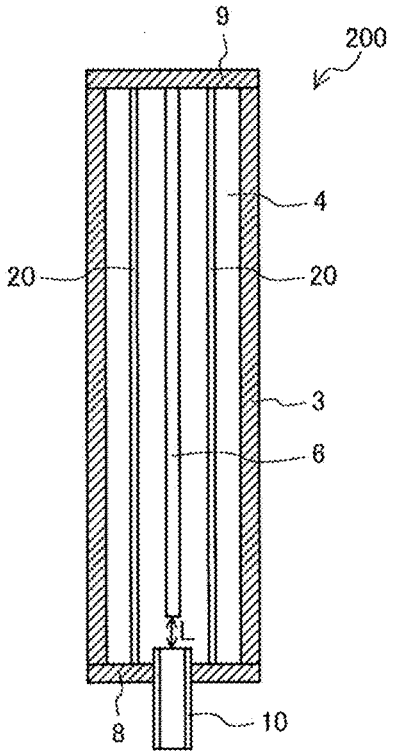
FIG. 27 is an example of a schematic plan view of a cross section of a refrigerant distributor of a heat exchanger according to Embodiment 7 of the present disclosure.

FIG. 27 is an example of a schematic plan view of a cross section of a refrigerant distributor 200 of a heat exchanger 100 according to Embodiment 7 of the present disclosure.

In the heat exchanger 100 according to Embodiment 7, as illustrated in FIG. 27, the orifices 5 in the first partition plate 4 are formed as slits 20, and the slits 20 are provided above respective refrigerant flow passages, that is, the right and left refrigerant flow passages. In this configuration, two-phase gas-liquid refrigerant that flows through the inflow pipe 10 is distributed to the right and left flow passages at the upstream end of the second partition plate 6. Then, the refrigerant passes through the slits 20 provided above the respective flow passages, and is atomized.

Figure 28:
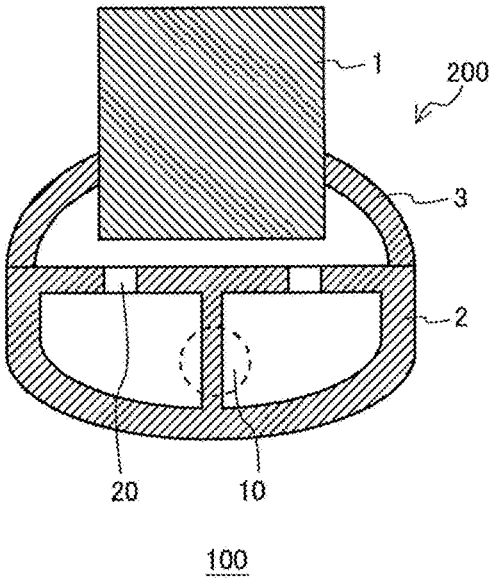
FIG. 28 is an example of a schematic side view of a vertical section of a heat exchanger according to a modification of Embodiment 7 of the present disclosure.

FIG. 28 is an example of a schematic side view of a vertical section of a heat exchanger 100 according to a modification of Embodiment 7 of the present disclosure.

In Embodiment 7, the sizes, shapes, locations, etc., of the slits 20 are not limited. However, the slits 20 are formed in such a manner as to extend to both ends of the first partition plate 4. In this configuration, it is possible to use extruded materials to form the refrigerant distributor 200 with a small number of components, and thus reduce the manufacturing cost. Furthermore, in the case where the first partition plate 4, the header outer-pipe top plate 3, the header outer-pipe bottom plate 2, the upstream side-surface lid 8, and the downstream side-surface lid 9 are formed of clad materials, these components can be brazed together.

As described above, in the heat exchanger 100 according to Embodiment 7, the orifices 5 are formed as the slits 20.

The heat exchanger 100 according to Embodiment 7 can obtain similar advantages to those obtained by Embodiment 1.

Further, in the heat exchanger 100 according to Embodiment 7, the slits 20 are formed to extend to the both ends of the first partition plate 4. The heat exchanger 100 according to Embodiment 7 can be manufactured at a lower cost.

Embodiment 8 of the present disclosure will be described. Regarding Embodiment 8, components that are the same as or equivalent to those in any of Embodiments 1 to 7 will be denoted by same reference signs, and their descriptions will not be repeated if they have already been made.

Figure 29:
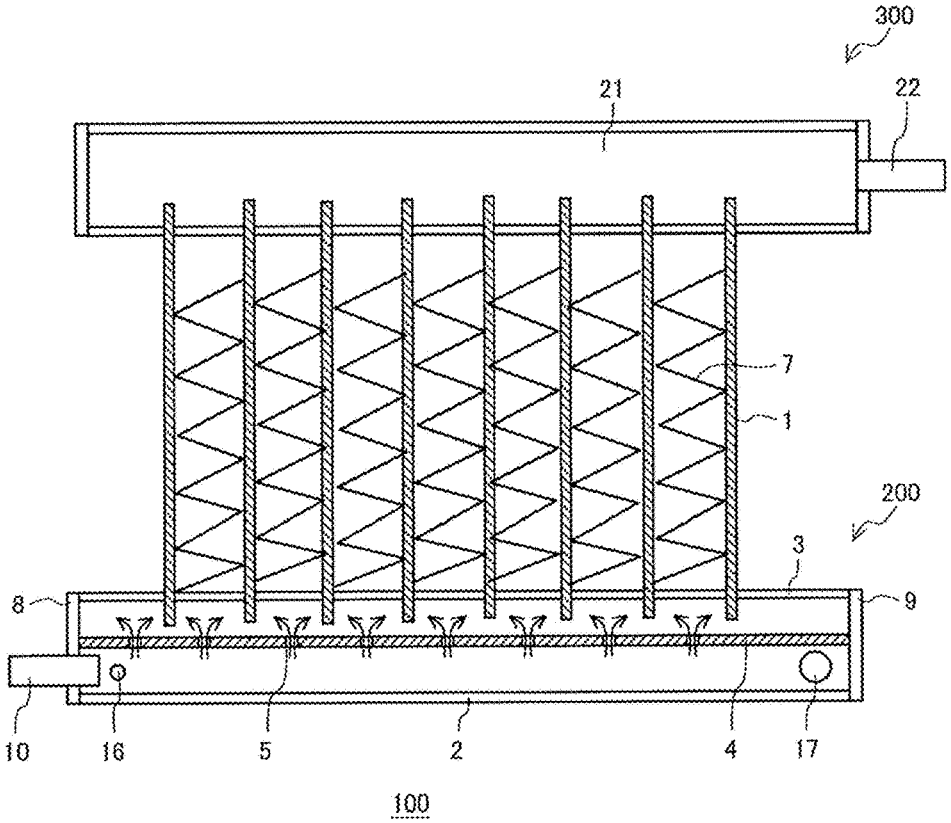
FIG. 29 is an example of a schematic front view of a vertical section of a heat exchanger according to Embodiment 8 of the present disclosure.

FIG. 29 is an example of a schematic front view of a vertical section of a heat exchanger 100 according to Embodiment 8 of the present disclosure.

In the heat exchanger 100 according to Embodiment 8, as illustrated in FIG. 29, one end of each of the flat tubes 1 is connected to the refrigerant distributor 200 in the vertical direction, and the other end of the flat tube 1 is connected to a gas header 300 in the vertical direction. The refrigerant distributor 200 is provided on a lower side of the flat tubes 1, and the gas header 300 is provided on an upper side of the flat tubes 1. The refrigerant distributor 200 is located on an upstream side in the flow of refrigerant, and the gas header 300 is located on the downstream side in the flow of refrigerant.

Furthermore, corrugated fins 7 are provided between adjacent flat tubes 1, and are joined to surfaces of outer tubes of the flat tubes 1. Regarding 8, although it is described that the corrugated fins 7 are provided as fins of the heat exchanger 100, it is not limiting. Another type of fins such as plate fins may be used.

Furthermore, an outflow pipe 22 through which refrigerant flows out is connected to one end of a header portion 21 of the gas header 300 in such a manner as to extend though the end. It should be noted that in the case where the outflow pipe 22 is provided opposite to and far from the inflow pipe 10, the pressure losses approach uniform pressure losses, and the refrigerant distribution performance is easily improved.

In the gas header 300, refrigerants subjected to heat exchange at the flat tubes 1 join each other at the header portion 21 of the gas header 300, and then flow out from the outflow pipe 22.

Figure 30:
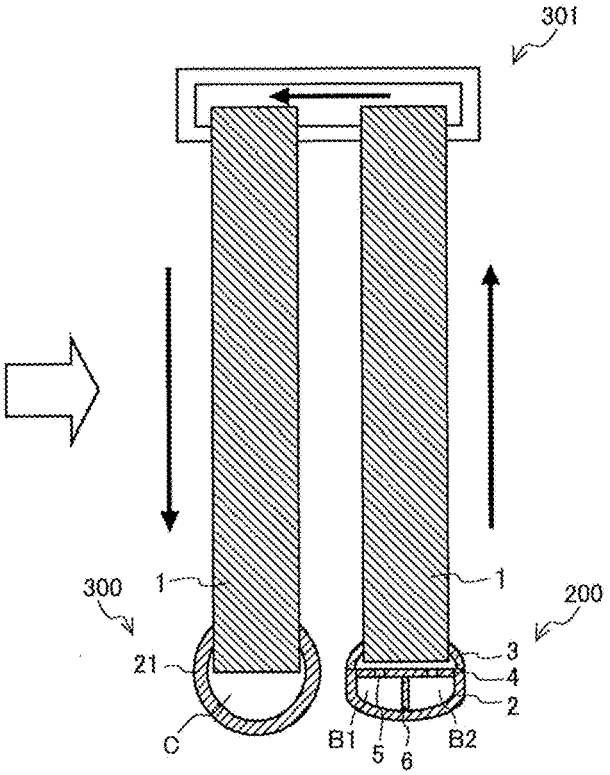
FIG. 30 is an example of a schematic side view of a vertical section of a heat exchanger according to the first modification of Embodiment 8 of the present disclosure.

FIG. 30 is an example of a schematic side view of a vertical section of a heat exchanger 100 according to the first modification of Embodiment 8 of the present disclosure. In FIG. 30, a white arrow indicates the flow of air that passes through the heat exchanger 100, and black arrows indicate the flow of refrigerant.

Referring to FIG. 29, the gas header 300 is provided on the upper side of the flat tubes 1, and the refrigerant distributor 200 is provided on the lower side of the flat tubes 1. Alternatively, as illustrated in FIG. 30, the gas header 300, as well as the refrigerant distributor 200, may be provided on the lower side of the flat tubes 1. In this case, a bridging header 301 is provided on the upper side of the flat tubes 1. Furthermore, the flat tubes 1 are arranged in units of two lines in a direction parallel to the width direction of the heat exchanger 100. Moreover, one of ends of each of the flat tubes 1 arranged in two lines in the width direction is connected to the bridging header 301, and the other end of the flat tube 1 on the leeward side is connected to the refrigerant distributor 200. The flat tube 1 on the windward side has an end connected to the gas header 300. In addition, the refrigerant that flows through the flat tube 1 located on the leeward side turns back at the bridging header 301 to flow through the flat tube 1 provided on the windward side.

Because of provision of the above configuration, the length of a flow passage in the flat tubes 1 is increased and the pressure loss in the refrigerant distributor 200 is thus relatively small, thus improving the refrigerant distribution. Furthermore, in the case where the heat exchanger 100 is configured such that a plurality of flat tubes 1 are arranged in the width direction, and the refrigerant distributor 200 is provided on the leeward side, and the gas header 300 is provided on the windward side, it is possible to easily increase the difference between the temperature of air and the temperature of refrigerant under the effect of an opposed flow, thus improving the heat exchange efficiency.

In Embodiment 8, the outer pipe shape of the gas header 300 is circular as illustrated in FIG. 30, but it is not limited to this shape. However, in the case where the outer pipe shape of the gas header 300 is circular, the length of part of the flat tubes 1 that are inserted into the gas header 300 tends to be longer than that of part of the flat tubes 1 that are inserted into the refrigerant distributor 200 in view of brazing of the flat tubes 1. Therefore, since the pressure loss in a flow passage in the gas header 300 is increased due to the influence of the length of the above inserted part of the flat tubes 1, it is preferable to reduce the increase.

In view of the above, the flow passages are set such that the relationship $B1+B2 \leq C$ is satisfied, where B1 is the effective flow passage cross-sectional area of the left flow passage of the refrigerant distributor 200, B2 is the effective flow passage cross-sectional area of the right flow passage of the refrigerant distributor 200, and C is the effective flow passage cross-sectional area of the gas header 300. In this configuration, it is possible to reduce the pressure loss in the gas header 300.

Figure 31:
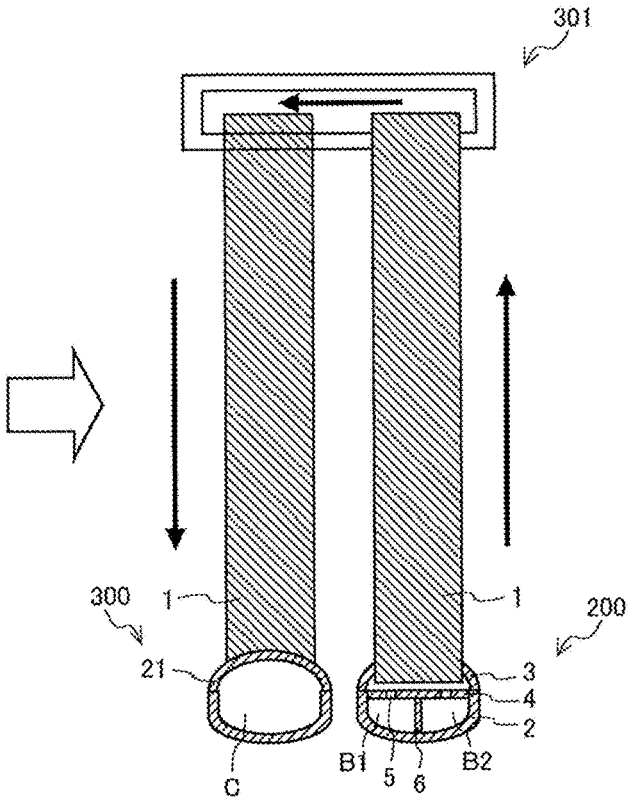
FIG. 31 is an example of a schematic side view of a vertical section of a heat exchanger according to the second modification of Embodiment 8 of the present disclosure.

FIG. 31 is an example of a schematic side view of a vertical section of a heat exchanger 100 according to the second modification of Embodiment 8 of the present disclosure. In FIG. 31, a white arrow indicates the flow of air that passes through the heat exchanger 100, and black arrows indicate the flow of refrigerant.

As illustrated in FIG. 31, the outer pipe shape of the gas header 300 may be the same as the outer pipe shape of the refrigerant distributor 200, and the height of the gas header 300 may be the same as the height of the refrigerant distributor 200. In this configuration, air that passes through the heat exchanger 100 collides with a smaller number of parts of the gas header 300 or the refrigerant distributor 200, thus reducing an increase in air resistance. Furthermore, since the outer pipe shape of the gas header 300 is the same as that of the refrigerant distributor 200, the gas header 300 and the refrigerant distributor 200 can be made to include the same components.

As described above, the heat exchanger 100 according to Embodiment 8 further includes a gas header 300 at which flows of refrigerant subjected to heat exchange at the heat transfer tubes join each other and a bridging header 301 that connects the refrigerant distributor 200 and the gas header 300, and the heat transfer tubes are arranged in two lines in the width direction of the refrigerant distributor 200. Furthermore, both the heat transfer tubes arranged in two lines have upper ends connected to the bridging header 301, one of the the heat transfer tubes arranged in two lines has lower ends connected to the refrigerant distributor 200, and the other of the heat transfer tubes has lower ends connected to the gas header 300.

In the heat exchanger 100 according to Embodiment 8, the length of a flow passage in the flat tubes 1 is increased and the pressure loss in the refrigerant distributor 200 is thus relatively small, thereby improving the refrigerant distribution. Furthermore, in the case where the heat exchanger 100 is configured such that a plurality of flat tubes 1 are arranged in the width direction, the refrigerant distributor 200 is provided on the leeward side, and the gas header 300 is provided on the windward side. As a result, it is possible to increase the temperature difference between air and refrigerant because of the effect of an opposed flow, thus improving the heat exchange efficiency.

Embodiment 9

Embodiment 9 of the present disclosure will be described. Regarding Embodiment 9, components that are the same as or equivalent to those in any of Embodiments 1 to 8 will be denoted by same reference signs, and their descriptions will not be repeated if they have already been made.

Figure 32:
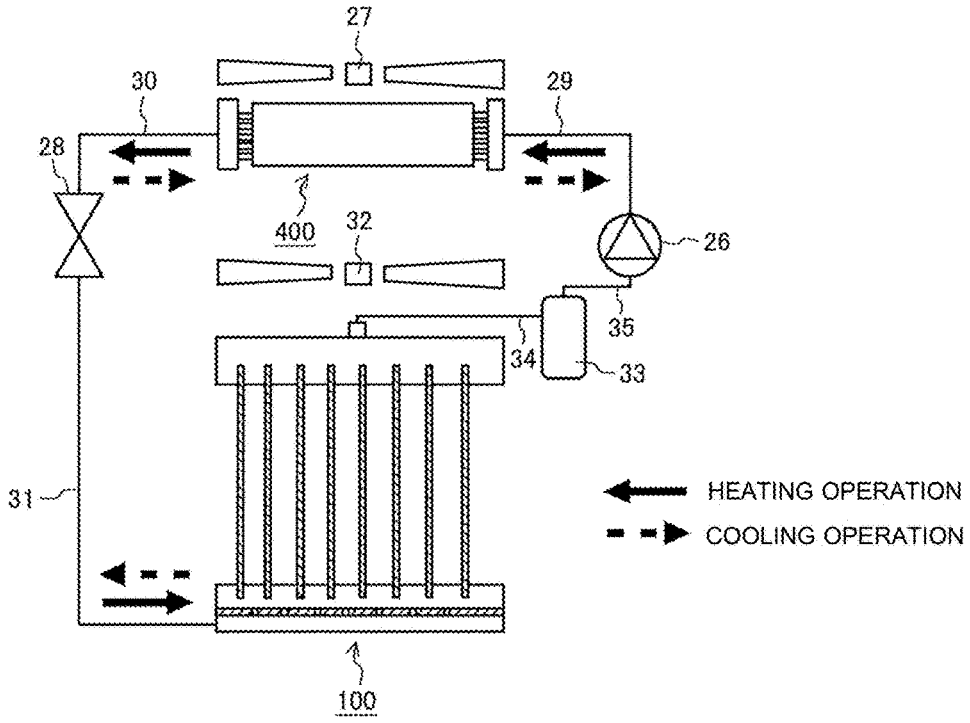
FIG. 32 is a diagram illustrating an example of a refrigerant circuit of an air-conditioning apparatus mounted with a heat exchanger according to Embodiment 9 of the present disclosure.

FIG. 32 is a diagram illustrating an example of a refrigerant circuit of an air-conditioning apparatus incorporating a heat exchanger 100 according to Embodiment 9 of the present disclosure. In FIG. 32, solid arrows indicate the flow of refrigerant during a heating operation, and dashed arrows indicate the flow of refrigerant during a cooling operation.

In the air-conditioning apparatus according to Embodiment 9, any of the heat exchangers 100 as described regarding Embodiments 1 to 8 is mounted in an outdoor unit. Furthermore, in the refrigerant circuit of the air-conditioning apparatus, as illustrated in FIG. 32, a compressor 26, an indoor unit that includes a fan 27 and a heat exchanger 400, an expansion valve 28, the outdoor unit, which includes a fan 32 and the heat exchanger 100, and an accumulator 33 are sequentially connected by pipes 29, 30, 31, 34, and 35.

Furthermore, an example of refrigerant that flows in the refrigerant circuit is low-pressure refrigerant such as olefin refrigerant (such as R1234yf or R1234ze (E)), propane, DME (dimethyl ether), or a refrigerant mixture having any of these refrigerants added as one of its components. Another example of the refrigerant is a zeotropic refrigerant mixture having different boiling points. Since any of the above refrigerants is used as the refrigerant that flows in the refrigerant circuit, it is possible to obtain the advantages as described regarding Embodiment 1.

Next, the flow of refrigerant in the heating operation of the air-conditioning apparatus will be described with reference to FIG. 32.

The refrigerant is changed into high-temperature and high-pressure gas refrigerant by the compressor 26. Then, the gas refrigerant flows into the heat exchanger 400. In the heat exchanger 400, which operates as a condenser, the gas refrigerant exchanges heat with air supplied by the fan 27 to condense and change into high-pressure liquid refrigerant. After that, the liquid refrigerant is reduced in pressure by the expansion valve 28 to change into low-temperature and low-pressure two-phase gas-liquid refrigerant, and the two-phase gas-liquid refrigerant flows into the heat exchanger 100, which includes a refrigerant distributor 200.

The two-phase gas-liquid refrigerant is appropriately distributed by the refrigerant distributor 200 in the heat exchanger 100, which operates as an evaporator, and exchanges heat with air supplied by the fan 32 to evaporate and change into gas refrigerant. At this time, the refrigerant flows as a vertical upward flow through the heat exchanger 100. In such a manner, since the refrigerant flows as a vertical upward flow through the heat exchanger 100, the flow of the two-phase gas-liquid refrigerant in the refrigerant distributor 200 can be turned into a horizontal flow that is hardly affected by gravity. It is therefore possible to improve the refrigerant distribution.

After that, the gas refrigerant re-flows into the compressor 26 via the accumulator 33. It is appropriate that the opening degree of the expansion valve 28, the amount of refrigerant that is applied as charge, and the rotation speed of the compressor 26 are adjusted. In this case, it is possible to change the flow state of refrigerant that flows through the refrigerant distributor 200 into a flow state in which a large amount of gas refrigerant flows near the center of the pipe, for example, it is changed to an annular flow or a churn flow, thus widening the range in which the refrigerant distribution is improved. For this purpose, the quality at the inlet of the refrigerant distributor 200 may be controlled to fall within the range of 0.10 to 0.20, preferably, the range of 0.15 to 0.30.

Next, the flow of refrigerant during the cooling operation of the air-conditioning apparatus will be described with reference to FIG. 32.

The refrigerant is changed into high-temperature and high-pressure gas refrigerant by the compressor 26. Then, the gas refrigerant flows into the heat exchanger 100, which includes the refrigerant distributor 200. In the heat exchanger 100, which operates as a condenser, the gas refrigerant exchanges heat with air supplied by the fan 27 to condense and change into high-pressure liquid refrigerant. After that, the liquid refrigerant is reduced in pressure by the expansion valve 28 to change into low-temperature and low-pressure two-phase gas-liquid refrigerant, and the two-phase gas-liquid refrigerant flows into the heat exchanger 400. In the heat exchanger 400, which operates as an evaporator, the two-phase gas-liquid refrigerant exchanges heat with air supplied by the fan 27 to evaporate and change into gas refrigerant. After that, the gas refrigerant re-flows back the compressor 26 via the accumulator 33.

Although Embodiment 9 is described above in such a simplified manner that the operation is switched between the cooling operation and the heating operation by reversing the flow of refrigerant, the operation may be switched between the cooling operation and the heating operation by using, for example, a four-way valve.

As described above, the air-conditioning apparatus according to Embodiment 9 includes a refrigerant circuit in which a compressor 26, a condenser, an expansion valve 28, and an evaporator are connected by pipes 29, 30, 31, 34, and 35 and through which refrigerant flows, and any of the heat exchangers 100 as described regarding Embodiments 1 to 8 is mounted as the condenser or the evaporator. In the air-conditioning apparatus according to Embodiment 9, it is possible to obtain similar advantages to those of Embodiments 1 to 8.

Embodiment 10

Embodiment 10 of the present disclosure will be described. Regarding Embodiment 10, components that are the same as or equivalent to those in any of Embodiments 1 to 9 will be denoted by same reference signs, and their descriptions will not be repeated if they have already been made.

Figure 33:
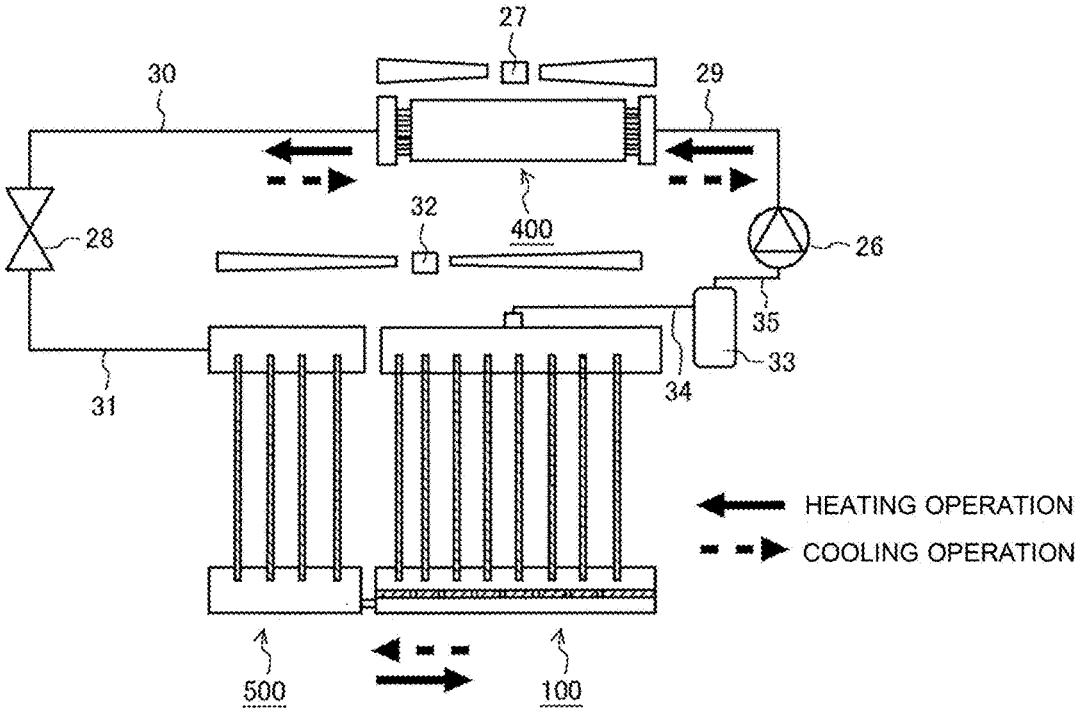
FIG. 33 is a diagram illustrating an example of a refrigerant circuit of an air-conditioning apparatus incorporating a heat exchanger according to Embodiment 10 of the present disclosure.

FIG. 33 is a diagram illustrating an example of a refrigerant circuit of an air-conditioning apparatus incorporating a heat exchanger 100 according to Embodiment 10 of the present disclosure. In FIG. 33, solid arrows indicate the flow of refrigerant during the heating operation, and dashed arrows indicate the flow of refrigerant during the cooling operation.

In the air-conditioning apparatus according to Embodiment 10, any of the heat exchangers 100 as described regarding Embodiments 1 to 8 is mounted in an outdoor unit. The refrigerant circuit of the air-conditioning apparatus is configured such that as illustrated in FIG. 33, a compressor 26, an indoor unit including a fan 27 and a heat exchanger 400, an expansion valve 28, a fan 32, the outdoor unit, which includes the heat exchanger 100 and a subcooling heat exchanger 500, and an accumulator 33 are sequentially connected by pipes 29, 30, 31, 34, and 35.

That is, in Embodiment 10, the subcooling heat exchanger 500 is provided downstream of the heat exchanger 100 in the flow direction of refrigerant during the cooling operation. Because of provision of the subcooling heat exchanger 500, during the cooling operation, the gas refrigerant is cooled in the heat exchanger 100, and it is possible to improve the transfer of heat of refrigerant whose quality has been low and whose flow velocity has also been low, and thus improve a cooling performance.

It is preferable that the subcooling heat exchanger 500 include a smaller number of flat tubes than the heat exchanger 100. Because of such a configuration, it is possible to increase the flow velocity of refrigerant and improve the cooling performance.

Furthermore, it should be noted that regarding the heating operation, the quality at the inlet of the refrigerant distributor 200 in heating 100% load operation of the subcooling heat exchanger 500, the quality at the inlet of the refrigerant distributor 200 in heating 50% load operation of the subcooling heat exchanger 500, and the quality at the inlet of the refrigerant distributor 200 in heating 25% load operation of the subcooling heat exchanger 500 are defined as x1, x2, and x3, respectively. In this case, the number of flat tubes is set smaller than in the heat exchanger 100 such that x1>x2>x3, the quality is increased under conditions where the flow rate of refrigerant is low. Thus, it is possible to improve refrigerant distribution in a wide flow range.

As described above, in the air-conditioning apparatus according to Embodiment 10, a subcooling heat exchanger 500 is provided downstream of the heat exchanger 100 in the flow direction of the refrigerant during the cooling operation. In the air-conditioning apparatus according to Embodiment 10, during the cooling operation, the gas refrigerant is cooled in the heat exchanger 100, and it is possible to improve the transfer of heat of refrigerant whose quality has been low and whose flow velocity has also been low, and thus to improve the cooling performance.

REFERENCE SIGNS LIST

1 flat tube, 1*a* partition pillar, 1*b* projecting portion, 2 header outer-pipe bottom plate, 3 header outer-pipe top plate, 3*a* insertion hole, 4 first partition plate, 5 orifice, 6 second partition plate, 6*a* second partition plate, 7 corrugated fin, 8 upstream side-surface lid, 9 downstream side-surface lid, 10 inflow pipe, 12 flow passage closing plate, 13 sealed space, 16 first left-right through-hole, 17 second left-right through-hole, 20 slit, 21 header portion, 22 outflow pipe, 26 compressor, 27 fan, 28 expansion valve, 29 pipe, 30 pipe, 31 pipe, 32 fan, 33 accumulator, 34 pipe, 35 pipe, 36 first space, 37 second space, 100 heat exchanger, 101 heat exchanger, 200 refrigerant distributor, 300 gas header, 301 interline header, 400 heat exchanger, 500 subcooling heat exchanger

The invention claimed is:

1. A heat exchanger comprising:

a plurality of heat transfer tubes that are flat tubes; and a tubular refrigerant distributor having insertion holes that are spaced from each other in a first direction, and that are provided as holes into which ends of the heat transfer tubes are inserted in a second direction perpendicular to the first direction, wherein the refrigerant distributor includes a first partition plate configured to partition an interior of the refrigerant distributor into a first space into which the ends of the heat transfer tubes are inserted and a second space into which the ends of the heat transfer tubes are not inserted, the second space being larger in volume than the first space, an inflow pipe provided on a one side-surface side of the refrigerant distributor, and configured to allow two-phase gas-liquid refrigerant to flow into the second space, and a second partition plate configured to partition the second space in a third direction perpendicular to the first direction and the second direction to form two refrigerant flow passages in the second space, wherein the heat transfer tubes are inserted in the insertion holes such that the ends of the heat transfer tubes are located apart from the first partition plate in the first space, and wherein the first partition plate is provided with a plurality of orifices, one of the orifices is provided between each pair of adjacent heat transfer tubes in the plurality of heat transfer tubes, the plurality of orifices causes the first space and the second space to communicate with each other, and the plurality of orifices are spaced from each other in the third direction.

2. The heat exchanger of claim 1, wherein the refrigerant distributor includes a flow passage closing plate that is provided in a middle of one of the two refrigerant flow passages and configured to close the one of the refrigerant flow passages.

3. The heat exchanger of claim 1, wherein the plurality of orifices are each provided between associated adjacent ones of the heat transfer tubes, and of the plurality of orifices, orifices provided above one of the refrigerant flow passages are located close only to the one-side surface side, and orifices provided above the other refrigerant flow passage are located close only to an other side-surface side located opposite to the one side-surface side.

4. The heat exchanger of claim 3, wherein the flow passage closing plate is provided closer to the other side-surface side located opposite to the one side-surface side than one of the plurality of orifices that is the closest to the other side-surface side located opposite to the one side-surface side.

5. The heat exchanger of claim 1, wherein the second partition plate is provided only in an area close to an other side-surface side located opposite to the one side-surface side.

6. The heat exchanger of claim 2, wherein the flow passage closing plate is provided closer to the one side-surface side than one of the plurality of orifices that is the closest to the one side-surface side, and a gap is provided between the second partition plate and an other side-surface side located opposite to the one side-surface side.

7. The heat exchanger of claim 2, wherein the second partition plate includes a first plate close to the one side-surface side and a second plate close to an other side-surface side located opposite to the one side-surface side, gaps are provided between the first plate and the second plate, between the one side-surface side and the first plate, and between the other side-surface side located opposite to the one side-surface side and the second plate, and the flow passage closing plate is provided in the gap between the first plate and the second plate and located apart from the first plate and the second plate.

8. The heat exchanger of claim 1, wherein gaps are provided between the second partition plate and the one side-surface side and between the second partition plate and an other side-surface side located opposite to the one side-surface side, and the gap between the second partition plate and the other side-surface side located opposite to the one side-surface side is larger than the gap between the second partition plate and the one side-surface side.

9. The heat exchanger of claim 1, wherein the second partition plate is provided to extend from the one side-surface side to an other side-surface side located opposite to the one side-surface side, the second partition plate has openings, formed close to the one side-surface side and the other side-surface side located opposite to the one side-surface side, through each of which refrigerant passes, and the opening formed close to the other side-surface side located opposite to the one side-surface side is larger than the opening formed close to the one side-surface side.

10. The heat exchanger of claim 1, wherein the inflow pipe and the second partition plate are provided apart from each other.

11. The heat exchanger of claim 1, wherein the distance between the inflow pipe and the second partition plate is greater than or equal to an inner diameter of the inflow pipe.

12. The heat exchanger of claim 1, wherein the refrigerant distributor is bent to be L-shaped.

13. The heat exchanger of claim 1, wherein the second space of the refrigerant distributor is longer in the third direction than in the first direction.

14. The heat exchanger of claim 1, wherein the first direction is a horizontal direction, the second direction is a vertical direction, and the third direction is a width direction of the refrigerant distributor.

15. The heat exchanger of claim 1, wherein the insertion holes are shaped longer in the third direction than in the first direction.

16. The heat exchanger of claim 1, further comprising:

a gas header in which flows of refrigerant subjected to heat exchange in the heat transfer tubes join each other; and a bridging header configured to connect the refrigerant distributor and the gas header, wherein the heat transfer tubes are arranged in two lines in a width direction of the refrigerant distributor, both the heat transfer tubes arranged in two lines have upper ends connected to the bridging header, one of the heat transfer tubes arranged in two lines has lower ends connected to the refrigerant distributor, and the other of the heat transfer tubes arranged in two lines has lower ends connected to the gas header.

17. The heat exchanger of claim 1, wherein each of the plurality of orifices includes a slit.

18. The heat exchanger of claim 17, wherein the slit of each of the plurality of orifices is formed to extend to both ends of the first partition plate.

19. The heat exchanger of claim 1, wherein a corrugated fin is provided between adjacent ones of the heat transfer tubes.

20. The heat exchanger of claim 1, wherein one of two refrigerant flow passages in the second space of the refrigerant distributor is larger in flow passage cross-sectional area than the other of the two refrigerant flow passages.

21. An air-conditioning apparatus comprising a refrigerant circuit in which a compressor, a condenser, an expansion valve, and an evaporator are connected by pipes and through which refrigerant flows, wherein the heat exchanger of claim 1 is used as the condenser or the evaporator.

22. The air-conditioning apparatus of claim 21, wherein when the heat exchanger is used as the evaporator, the refrigerant flows as a vertical upward flow through the heat transfer tubes.

23. The air-conditioning apparatus of claim 21, which performs cooling operation, and wherein a subcooling heat exchanger is provided downstream of the heat exchanger in a direction of flow of the refrigerant during the cooling operation.

24. The air-conditioning apparatus of claim 21, wherein a zeotropic refrigerant mixture having different boiling points is used as the refrigerant that flows in the refrigerant circuit.

25. The air-conditioning apparatus of claim 21, wherein olefin refrigerant, propane, DME, or a refrigerant mixture containing any of olefin refrigerant, propane, and DME as one component is used as the refrigerant that flows in the refrigerant circuit.

26. A heat exchanger comprising:

a plurality of heat transfer tubes that are flat tubes; and a tubular refrigerant distributor having insertion holes that are spaced from each other in a first direction, and that are provided as holes into which ends of the heat transfer tubes are inserted in a second direction perpendicular to the first direction, wherein the refrigerant distributor includes a first partition plate configured to partition an interior of the refrigerant distributor into a first space into which the ends of the heat transfer tubes are inserted and a second space into which the ends of the heat transfer tubes are not inserted, the second space being larger in volume than the first space, an inflow pipe provided on a one side-surface side of the refrigerant distributor, and configured to allow two-phase gas-liquid refrigerant to flow into the second space, and a second partition plate configured to partition the second space in a third direction perpendicular to the first direction and the second direction to form two refrigerant flow passages in the second space, wherein the heat transfer tubes are inserted in the insertion holes such that the ends of the heat transfer tubes are located apart from the first partition plate in the first space, wherein the first partition plate is provided with a plurality of orifices, the center of each orifice provided at a location corresponding to a space between associated adjacent ones of the heat transfer tubes, and that causes the first space and the second space to communicate with each other, and the plurality of orifices are spaced from each other in the third direction, and wherein the second partition plate is provided only in an area close to an other side-surface side located opposite to the one side-surface side.

27. A heat exchanger comprising:

a plurality of heat transfer tubes that are flat tubes; and a tubular refrigerant distributor having insertion holes that are spaced from each other in a first direction, and that are provided as holes into which ends of the heat transfer tubes are inserted in a second direction perpendicular to the first direction, wherein the refrigerant distributor includes a first partition plate configured to partition an interior of the refrigerant distributor into a first space into which the ends of the heat transfer tubes are inserted and a second space into which the ends of the heat transfer tubes are not inserted, the second space being larger in volume than the first space, an inflow pipe provided on a one side-surface side of the refrigerant distributor, and configured to allow two-phase gas-liquid refrigerant to flow into the second space, and a second partition plate configured to partition the second space in a third direction perpendicular to the first direction and the second direction to form two refrigerant flow passages in the second space, wherein the heat transfer tubes are inserted in the insertion holes such that the ends of the heat transfer tubes are located apart from the first partition plate in the first space, wherein the first partition plate is provided with a plurality of orifices, the center of each orifice provided at a location corresponding to a space between associated adjacent ones of the heat transfer tubes, and that causes the first space and the second space to communicate with each other, and the plurality of orifices are spaced from each other in the third direction, and wherein one of two refrigerant flow passages in the second space of the refrigerant distributor is larger in flow passage cross-sectional area than the other of the two refrigerant flow passages.

* * * * *